US006895904B2

(12) United States Patent
Kobayashi et al.

(10) Patent No.: US 6,895,904 B2
(45) Date of Patent: May 24, 2005

(54) INTERNAL COMBUSTION ENGINE WITH REGENERATOR

(75) Inventors: Hideo Kobayashi, Mishima (JP); Kazuki Iwatani, Susono (JP); Makoto Suzuki, Mishima (JP); Katuhiko Arisawa, Susono (JP); Masakazu Tabata, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/684,486

(22) Filed: Oct. 15, 2003

(65) Prior Publication Data

US 2004/0079298 A1 Apr. 29, 2004

Related U.S. Application Data

(62) Division of application No. 10/109,717, filed on Apr. 1, 2002, now Pat. No. 6,681,725.

(30) Foreign Application Priority Data

Apr. 9, 2001 (JP) ..... 2001-110239

(51) Int. Cl.[7] ..... F02N 17/02
(52) U.S. Cl. ..... 123/41.14; 123/142.5 R
(58) Field of Search ..... 123/41.14, 142.5 R

(56) References Cited

U.S. PATENT DOCUMENTS

| | | | | |
|---|---|---|---|---|
| 4,364,338 A | | 12/1982 | Garcea | |
| 5,291,960 A | | 3/1994 | Brandenburg et al. | |
| 5,749,329 A | * | 5/1998 | Thurfjell | 123/41.14 |
| 5,765,511 A | * | 6/1998 | Schatz | 123/41.14 |
| 5,896,833 A | | 4/1999 | Aoki | |
| 6,138,618 A | * | 10/2000 | Genster | 123/41.14 |

FOREIGN PATENT DOCUMENTS

| | | |
|---|---|---|
| DE | 29 16 216 | 11/1980 |
| DE | 41 05 199 A1 | 8/1992 |
| DE | 42 14 850 A1 | 11/1993 |
| JP | A 6-185359 | 7/1994 |

* cited by examiner

*Primary Examiner*—Noah P. Kamen
(74) *Attorney, Agent, or Firm*—Oliff & Berridge, PLC

(57) ABSTRACT

An internal combustion engine includes a circulation system which circulates a heat medium, a cylinder head part channel which circulates the heat medium into a cylinder head, a cylinder block part channel which circulates the heat medium into a cylinder block, a connecting channel which connects the cylinder head part channel with the cylinder block part channel, a heat supply device that supplies heat accumulated in the regenerator to the internal combustion engine, and restraining device that restrains heat circulation in the connecting channel when heat is supplied by the heat supply device or the internal combustion engine is under cold conditions.

9 Claims, 11 Drawing Sheets

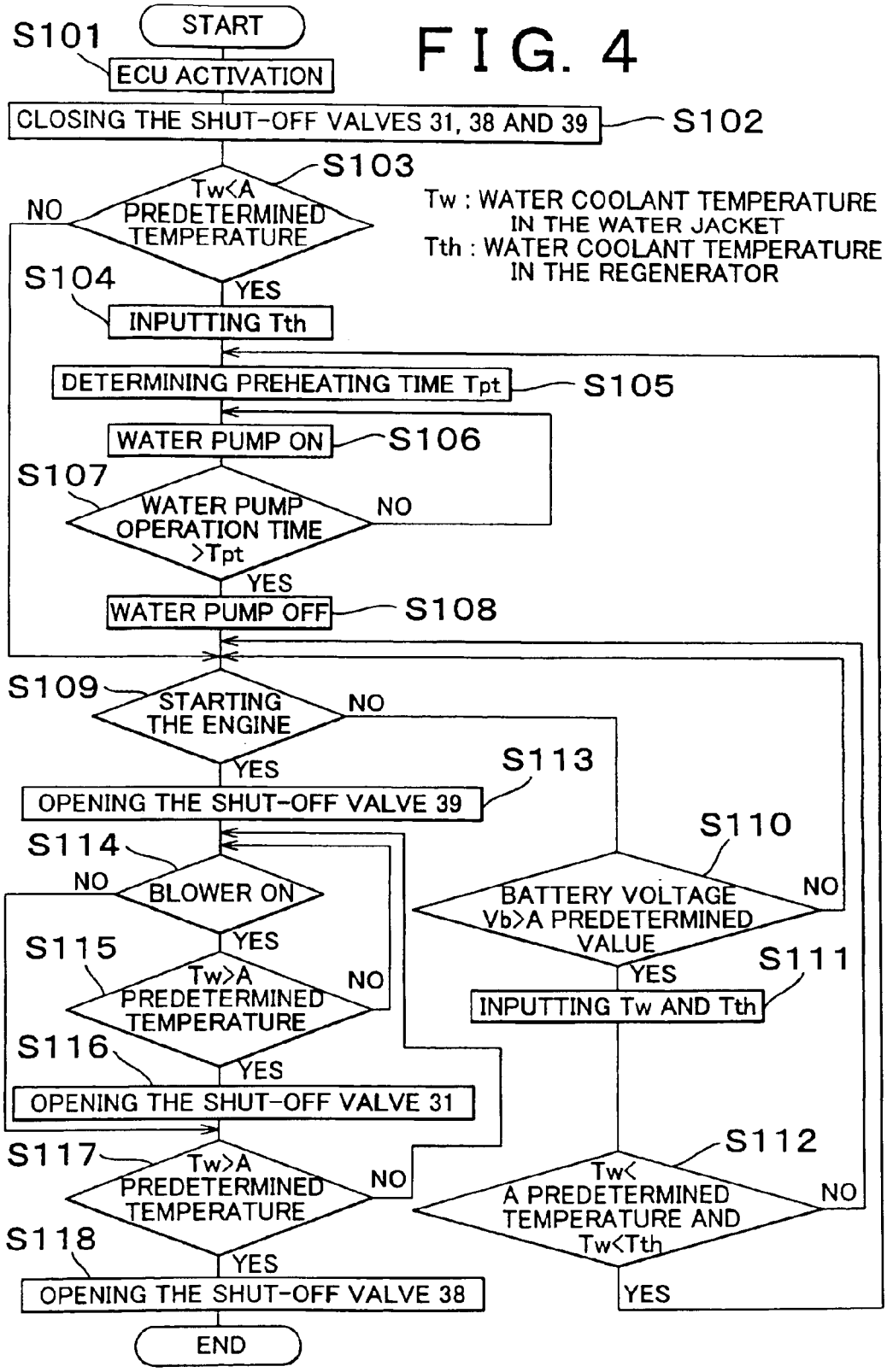
FIG. 4
START
S101
ECU ACTIVATION
CLOSING THE SHUT-OFF VALVES 31, 38 AND 39
S102
S103
Tw<A PREDETERMINED TEMPERATURE
NO
YES
Tw : WATER COOLANT TEMPERATURE IN THE WATER JACKET
Tth : WATER COOLANT TEMPERATURE IN THE REGENERATOR
S104
INPUTTING Tth
DETERMINING PREHEATING TIME Tpt
S105
WATER PUMP ON
S106
S107
WATER PUMP OPERATION TIME >Tpt
NO
YES
WATER PUMP OFF
S108
S109
STARTING THE ENGINE
NO
YES
S113
OPENING THE SHUT-OFF VALVE 39
S110
S114
BLOWER ON
NO
YES
BATTERY VOLTAGE Vb>A PREDETERMINED VALUE
NO
YES
S111
INPUTTING Tw AND Tth
S115
Tw>A PREDETERMINED TEMPERATURE
NO
YES
S116
OPENING THE SHUT-OFF VALVE 31
S117
Tw>A PREDETERMINED TEMPERATURE
NO
YES
S112
Tw< A PREDETERMINED TEMPERATURE AND Tw<Tth
NO
YES
S118
OPENING THE SHUT-OFF VALVE 38
END

INTERNAL COMBUSTION ENGINE WITH REGENERATOR

This is a Division of application Ser. No. 10/109,717 filed Apr. 1, 2002 now U.S. Pat. No. 6,681,725. The entire disclosure of the prior application is hereby incorporated by reference herein in its entirety.

INCORPORATION BY REFERENCE

The disclosure of Japanese Patent Application No. 2001-110239 filed on Apr. 9, 2001 including the specification, drawings and abstract is incorporated herein by reference in its entirety.

BACKGROUND OF THE INVENTION

1. Field of the Invention

This invention relates to an internal combustion engine equipped with a regenerator.

2. Description of the Related Art

Generally, when an internal combustion engine is running at temperatures under a predetermined temperature around combustion chambers, fuel atomization supplied to the combustion chambers deteriorates and so did exhaust gas emission due to quenching around walls of the combustion chambers.

In order to obviate this problem, an internal combustion engine equipped with a regenerator is being developed which can accumulate heat generated from combustion when the engine is running. Then the accumulated heat is supplied to the engine when the engine is not running or the engine needs to be started. However, the amount of heat accumulated in the regenerator is limited, then a technology which utilizes the limited amount of heat effectively is being disclosed.

According to Japanese patent application Laid-open No. 6-185359, the engine is equipped with a first coolant channel which supplies water coolant to a cylinder block, a second coolant channel which supplies coolant to a cylinder head independently and is connected to a regenerator.

A regenerator in the internal combustion engine which is formed according to the above prior technology supplies heat to the cylinder head intensively through the second coolant channel. The heat is emitted from the regenerator when the engine is under cold conditions. As mentioned above, the limited amount of heat can be supplied to the internal combustion engine effectively by supplying the heat accumulated in the regenerator to a cylinder head intensively. Therefore, emission performance and fuel efficiency can be improved.

However, a coolant channel, which is connected to the cylinder head and the cylinder block, flows into both the cylinder head and the cylinder block. Water coolant flows into devices such as a radiator and a heater core which are located outside the internal combustion engine since some of the water coolant channels are connected to these devices. If heat is supplied to a part where heat supply is not needed, the temperature of coolant drops unnecessarily which increases heat consumption in the regenerator. If a regenerator with large volume is to be installed in a vehicle, a quite large device is needed which makes the installation difficult. Even if the installation is possible, fuel consumption and automobile performance deteriorates due to the increased mass.

In this connection, an internal combustion engine needs to be warmed up before being started to start the internal combustion engine under warm conditions. However, it is difficult to precisely grasp the timing of starting the engine. Therefore, heat needs to be supplied to the internal combustion engine for a long period, when the timing of starting the engine is being delayed for some reason. The amount of heat accumulated in the regenerator is limited, and therefore it is important to utilize the heat effectively to supply heat to the internal combustion engine for a long period.

SUMMARY OF THE INVENTION

It is an object of the invention to provide a technology to supply heat to an internal combustion engine for a long period even when the internal combustion engine is turned off. Therefore, deterioration of exhaust emission can be prevented.

According to a first aspect of the invention, an internal combustion engine is equipped with an engine body, which includes a cylinder head and a cylinder block, and a regenerator which accumulates heat. The internal combustion engine further includes a circulation system which circulates a heat medium, a cylinder head part channel which circulates the heat medium into the cylinder head, a cylinder block part channel which circulates the heat medium into the cylinder block, a connecting channel which connects the cylinder head part channel with the cylinder block part channel, a heat supply device that supplies heat accumulated in the regenerator to the internal combustion engine through the heat medium in the circulation channel, and a restraining device that restrains heat circulation in the connecting channel when heat is supplied by the heat supply device or the internal combustion engine is under cold conditions.

In an internal combustion engine equipped with a regenerator according to the first aspect, the heat, which is generated when the internal combustion engine is running, is stored by the regenerator even after the internal combustion engine is turned off. The heat accumulated by the regenerator circulates into the circulation system through the heat medium. The heat medium passes the cylinder block part channel, the connecting channel, and the cylinder head part channel, all of which are provided in the internal combustion engine, after reaching the internal combustion engine. At this time, the heat medium supplies heat to the internal combustion engine.

As described above, the regenerator loses heat by supplying heat to the internal combustion engine. On the other hand, the heat is supplied to the internal combustion engine so that the temperature of the internal combustion engine rises even before the internal combustion engine is starting.

The restraining device restrains circulation of the heat medium in the connecting channel and in a part where heat supply is not needed in the internal combustion engine. For example, components of the internal combustion engine can be arranged in the way that the heat medium does not circulate in the cylinder block part channel since it is effective to mainly warm the cylinder head part to restrain deterioration of the exhaust gas emission.

As described above, the limited amount of heat accumulated in a regenerator can be supplied to an internal combustion engine for long period by restraining unnecessary heat consumption. Furthermore, downsizing a regenerator and shortening time to supply heat have been made possible.

The restraining device can be arranged in the way that circulation of the heat medium is shut off completely or can be a diaphragm through which the heat medium can circulate to a certain extent. Also, the restraining device can include a throttle valve which controls the amount of heat medium circulation or can be a thermostat valve which automatically opens and closes according to temperatures of the heat medium. Furthermore, the restraining device can be a electromagnetic valve which controls opening and closing the valve from outside of an internal combustion engine.

The restraining device can cancel restraining circulation of the heat medium when an internal combustion engine has started. The cancel can be conditioned on a period before and after starting an internal combustion engine or on that a certain time passes after starting an engine. Furthermore, the cancel can be conditioned on that the heat medium reaches a certain temperature.

According to a second aspect of the invention, an internal combustion engine is equipped with an engine body, which includes a cylinder head and a cylinder block, and a regenerator which accumulates heat. The internal combustion engine further includes a circulation system which circulates the heat medium, a cylinder head part channel which circulates the heat medium into the cylinder head, a cylinder block part channel which circulates the heat medium into the cylinder block, a connecting channel which connects the cylinder head part channel with the cylinder block part channel, a heat supply device that supplies the heat accumulated in the regenerator to the internal combustion engine through the heat medium in the circulation channel, and a circulation direction restraining device that restrains circulation directions of the heat medium in the connecting channel.

In an internal combustion engine equipped with a regenerator according to the second aspect, the heat, which is generated when the internal combustion engine is running, is stored by the regenerator even after the internal combustion engine is turned off. The heat accumulated by the regenerator circulates into the circulation system through the heat medium. The heat medium passes the cylinder block part channel, the connecting channel, and the cylinder head part channel, all of which are provided in the internal combustion engine, after reaching the internal combustion engine. At this time, the heat medium supplies heat to the internal combustion engine.

As described above, the regenerator loses heat by supplying heat to the internal combustion engine. On the other hand, the heat is supplied to the internal combustion engine so that the temperature of the internal combustion engine rises even before the internal combustion engine is starting.

The circulation direction restraining device restrains circulation directions of the heat medium in the connecting channel and in a part where heat supply is not needed in the internal combustion engine.

As described above, limited amount of heat accumulated in a regenerator can be supplied to an internal combustion engine for long period by restraining unnecessary heat consumption. Furthermore, downsizing a regenerator and shortening time to supply heat have been made possible.

The circulation direction restraining device restrains circulating the heat medium from a part where heat supply is needed to a part where heat supply is not needed in the internal combustion engine. On the other hand, the circulation direction restraining device does not restrain circulating the heat medium from a part where heat supply is not needed to a part where heat supply is needed. The above-mentioned fact is especially effective when the circulation directions of the heat medium are the opposite depending on whether heat is supplied from the regenerator or the internal combustion engine is running.

The circulation direction restraining device can be arranged in the way that circulation of the heat medium is shut off completely or in the way that the heat medium can circulate to a certain extent. Furthermore, the circulation direction restraining device can be arranged to control circulation amount of the heat medium.

The circulation direction restraining device can cancel restraining circulation of the heat medium when an internal combustion engine has started. The cancel can be conditioned on a period before and after starting an internal combustion engine or on that a certain time passes after starting an engine. Furthermore, the cancel can be conditioned on that the heat medium reaches a certain temperature.

In an internal combustion engine equipped with a cylinder head and a cylinder block according to the second aspect described above, the circulation direction restraining device can be arranged in the way that circulation of the heat medium from the cylinder head to the cylinder block is restrained.

In an internal combustion engine with a regenerator according to the above aspect, circulation of the heat medium from a cylinder head to a cylinder block can be restrained when heat is supplied from the regenerator. Therefore, unnecessary heat supply at the cylinder block can be restrained.

According to a third aspect of the invention, an internal combustion engine is equipped with a regenerator. The internal combustion engine further includes a circulation system which circulates the heat medium, a heat supply device that supplies heat accumulated in the regenerator to the internal combustion engine through the heat medium in the circulation system, a heat exchanger that lowers the temperature of the heat medium by conducting heat, and a connecting restraint device that restrains circulation of the heat medium in the heat exchanger when heat is supplied by the heat supply device or the internal combustion engine is under cold conditions.

In an internal combustion engine equipped with a regenerator, according to the third aspect, the heat, which is generated when the internal combustion engine is running, is stored by the regenerator even after the internal combustion engine is turned off. The heat accumulated by the regenerator circulates into the circulation system through the heat medium. The heat medium passes the cylinder block part channel, the connecting channel, and the cylinder head part channel, all of which are provided in the internal combustion engine, after reaching the internal combustion engine. At this time, the heat medium supplies heat to the internal combustion engine.

The heat exchanger is connected to the internal combustion engine through the circulation channel. The internal combustion engine, whose temperature is raised during running, emits heat to the heat medium. The heat medium, which is supplied heat, reaches the heat exchanger after the circulation system. The heat medium emits its heat at the heat exchanger which enables the heat medium to accept heat supply again.

However, when heat is supplied from the regenerator to the internal combustion engine and the heat medium passes the heat exchanger, the heat accumulated in the regenerator is emitted from the heat exchanger. The amount of heat which can be supplied to a part where heat supply is needed decreases when the heat is emitted from the heat exchanger since the amount of heat which can be accumulated in the regenerator is limited. Especially when the period from the beginning of heat supply to the start of the internal combustion engine is prolonged, the amount of heat decreases since the heat supply may repeat and the heat is emitted from the heat exchanger as a result of each heat supply. Then the period of possible supplying heat to the internal combustion engine is shortened.

To obviate the above-mentioned problem, the connecting restraint device restrains circulation of the heat medium in the circulation channel located between the internal combustion engine and the heat exchanger. The connecting restraint device can be arranged in the way that circulation of the heat medium is shut off completely or can be a diaphragm through which the heat medium can circulate to a certain extent. Also, the connecting restraint device can include a throttle valve which controls the amount of heat medium circulation.

The connecting restraint device can cancel restraining circulation of the heat medium when an internal combustion engine has started. The cancel can be conditioned on a period before and after starting an internal combustion engine or on that a certain time passes after starting an engine. Furthermore, the cancel can be conditioned on that the heat medium reaches a certain temperature.

The heat exchanger can be a heater for a vehicle compartment according to the invention.

According to a fourth aspect of the invention, an internal combustion engine is equipped with a regenerator. The internal combustion engine further includes a circulation system which circulates the heat medium, a heat supply device that supplies heat accumulated in the regenerator to the internal combustion engine through the heat medium in the circulation system, a bypass channel which connects a part on the side of the inlet of the internal combustion engine with a part on the side of the outlet of the internal combustion engine, a temperature controller that reintroduces the heat medium, which circulates into the internal combustion engine when the internal combustion engine is under cold conditions, to the internal combustion engine through the bypass channel, and a connecting restraint device that restrains circulation of the heat medium in the bypass channel when heat is supplied from the regenerator.

In an internal combustion engine equipped with a regenerator according to the fourth aspect, the heat, which is generated when the internal combustion engine is running, is stored by the regenerator even after the internal combustion engine is turned off. The heat accumulated by the regenerator circulates into the circulation system through the heat medium. The heat medium passes the cylinder block part channel, the connecting channel, and the cylinder head part channel, all of which are provided in the internal combustion engine, after reaching the internal combustion engine. At this time, the heat medium supplies heat to the internal combustion engine.

It is important to rapidly raise the temperature of the internal combustion engine since the exhaust emission may deteriorate when the temperature of the internal combustion engine is low right after starting. Then, the temperature controller circulates the heat medium into the internal combustion engine through the bypass channel not to emit the heat, which is emitted by the internal combustion engine, through a device such as the heat exchanger. As described above, rapid raising temperature of the internal combustion engine is possible.

However, when heat is supplied from the regenerator to the internal combustion engine and some of the heat medium circulates into the bypass channel, the heat from the heat medium in the bypass channel is not supplied to the internal combustion engine. Therefore, the amount of heat supplied to the internal combustion engine is decreased. Under this condition, the effect of heat supply from the regenerator is decreased.

The connecting restraint device can increase the effect of heat supply by restrain circulating the heat medium into the bypass channel. The connecting restraint device can be arranged in the way that circulation of the heat medium is shut off completely or can be a diaphragm through which the heat medium can circulate to a certain extent. Also, the connecting restraint device can include a throttle valve which controls the amount of heat medium circulation.

The connecting restraint device can cancel restraining circulation of the heat medium when an internal combustion engine has started. The cancel can be conditioned on a period before and after starting an internal combustion engine or on that a certain time passes after starting an engine. Furthermore, the cancel can be conditioned on that the heat medium reaches a certain temperature.

According to the third and fourth aspects, the connecting restraint device can be a thermostat valve which opens at a predetermined temperature or above.

According to the third and fourth aspects, the connecting restraint device can be a pressure-sensing valve which opens according to a difference in pressure of the heat medium before and after the connecting restraint device.

According to the third and fourth aspects, the connecting restraint device can be a one-way valve which opens when the valve receives pressure in a predetermined direction.

According to the third and fourth aspects, the connecting restraint device can be a electromagnetic opening and closing valve.

According to a fifth aspect of the invention, an internal combustion engine is equipped with a regenerator. The internal combustion engine further includes a circulation system which circulates the heat medium, a heat supply device that supplies heat accumulated in the regenerator to the internal combustion engine through the heat medium in the circulation system, a bypass channel which connects a part on the side of the inlet of the internal combustion engine with a part on the side of the outlet of the internal combustion engine, and a temperature controller that introduces the heat medium, which circulates into the internal combustion engine when the internal combustion engine is under cold conditions, to the internal combustion engine again through the bypass channel. Furthermore, the bypass channel includes the regenerator.

In an internal combustion engine equipped with a regenerator according to the fifth aspect, the heat, which is generated when the internal combustion engine is running, is stored by the regenerator even after the internal combustion engine is turned off. The heat accumulated by the regenerator circulates into the circulation system through the heat medium. The heat medium passes the cylinder block part channel, the connecting channel, and the cylinder head part channel, all of which are provided in the internal combustion engine, after reaching the internal combustion engine. At this time, the heat medium supplies heat to the internal combustion engine.

The bypass channel connects a part through which the heat medium flows into the internal combustion engine with a part through which the heat medium flows out of the internal combustion engine.

It is important to rapidly raise the temperature of the internal combustion engine since the exhaust emission may deteriorate when the temperature of the internal combustion engine is low right after starting. Then, the temperature controller circulates the heat medium into the internal combustion engine through the bypass channel until the heat medium reaches a predetermined temperature not to emit the heat, which is emitted by the internal combustion engine, through a device such as the heat exchanger. As described above, rapid raising temperature of the internal combustion engine is possible.

According to the fifth aspect, the circulation system, which circulates the heat medium, and the bypass channel, which circulates the heat medium when the temperature of the heat medium is low and the internal combustion engine is running, are in common.

According to the fifth aspect, heat can be supplied to the internal combustion engine no matter whether the internal combustion engine is running or not. And simplification of the device is possible.

BRIEF DESCRIPTION OF THE DRAWINGS

FIG. 4 is a flow chart which indicates flow of the engine-preheat according to the first embodiment.

DETAILED DESCRIPTION OF THE PREFERRED EMBODIMENTS

The following explains detailed preferred embodiments according to the drawings mentioned above. This part explains a regenerator of the internal combustion engine according to the invention by giving the example of applying a regenerator to a direct-injection gasoline engine.

The First Embodiment

Figure 1:
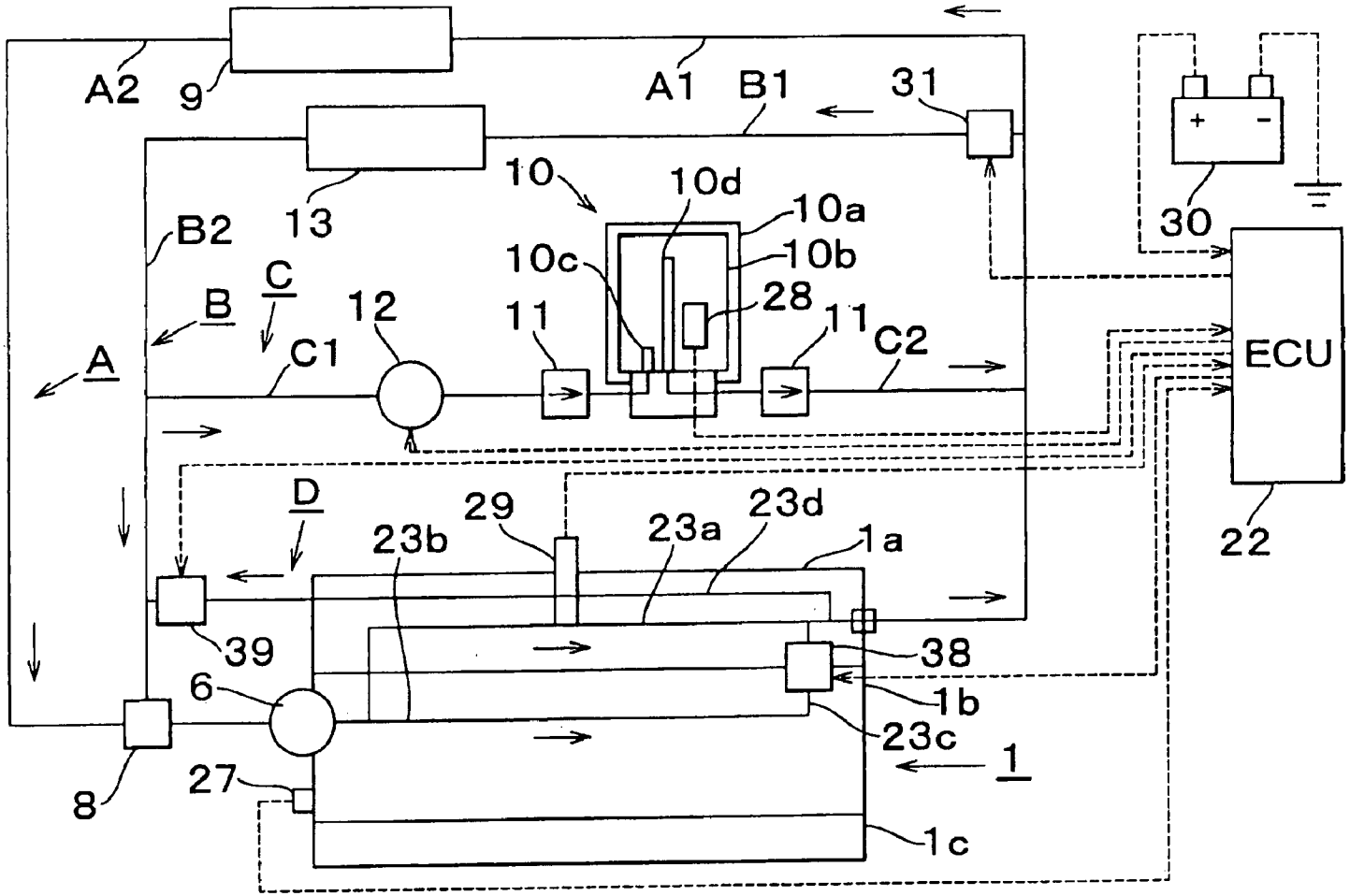
FIG. 1 is a schematic view of an engine applying the regenerator of the internal combustion engine according to the first embodiment and cooling channels in which water coolant circulates.

FIG. 1 is a schematic view which shows an engine 1 applying a regenerator of the internal combustion engine according to the first embodiment and water coolant channels A, B, C, and D (circulation channels). The arrows indicated in the circulation channels represent the flowing directions of water coolant when the engine 1 is running.

The engine 1 shown in FIG. 1 is a water-cooled 4-cycle gasoline engine.

The engine 1 includes a cylinder head 1*a,* a cylinder block 1*b* which is connected to the lower part of the cylinder head 1*a,* an oil pan 1*c* which is connected to the lower part of the cylinder block 1*b.*

The cylinder head 1*a* and the cylinder block 1*b* are equipped with a water jacket 23 through which water coolant circulates. A water pump 6, which sucks in water coolant outside the engine 1 and spurts out the water coolant inside the engine 1, is provided at the inlet of the water jacket 23. The water pump 6 is driven by torque of the output shaft of the engine 1. In other words, the water pump 6 can only be driven when the engine 1 is running. Furthermore, the engine 1 is equipped with an in-engine water coolant temperature sensor 29 which transmits the signals according to water coolant temperature in the water jacket 23.

There are four circulation channels as channels to circulate water coolant through the engine 1. The four circulation channels are a circulation channel A which circulates through a radiator 9, a circulation channel B which circulates through a heater core 13, a circulation channel C which circulates through a regenerator 10, and a circulation channel D which circulates in the engine 1. Each circulation channel shares a section with the other circulation channels.

The circulation channel A has the main function of lowering water coolant temperature by emitting heat of the water coolant from the radiator 9.

The circulation channel A includes a radiator inlet-side channels A1, a radiator outlet-side channel A2, the radiator 9, and the water jacket 23. One end of the radiator inlet-side channel A1 is connected to the cylinder head 1*a.* The other end of radiator inlet-side channel A1 is connected to the inlet of the radiator 9.

One end of the radiator outlet-side channel A2 is connected to the outlet of the radiator 9. The other end of the radiator outlet-side channel A2 is connected to the cylinder block 1*b.* The radiator outlet-side channel A2 which starts from the outlet of the radiator 9 to the cylinder block includes a thermostat 8. The thermostat 8 has the function of opening the valve when the water coolant temperature reaches a predetermined temperature. The water pump 6 is located between the radiator outlet-side channel A2 and the cylinder block.

The water jacket 23 includes a head-side water jacket 23*a* and a block-side water jacket 23*b.* The head-side water jacket 23*a,* which cools the cylinder head 1*a,* is provided mainly at the cylinder head 1*a.* The block-side water jacket 23*b,* which cools the cylinder block 1*b,* is provided mainly at the cylinder block 1*b.* The head-side water jacket 23*a* and the block-side water jacket 23*b* are connected through a connecting channel 23*c.* The connecting channel 23*c* includes a shut-off valve 38 which opens and closes according to the signals from an ECU 22.

The circulation channel B has the main function of raising ambient temperature in a compartment by emitting heat of water coolant from the heater core 13.

The circulation channel B includes a heater core inlet-side channel B1, a heater core outlet-side channel B2, the heater core 13, and the water jacket 23. One end of the heater core inlet-side channel B1 is connected to midway of the radiator inlet-side channel A1. A channel from the cylinder head 1*a* to the connection described above, which is a part of the heater core inlet-side channel B1, is shared by the radiator inlet-side channel A1. The other end of the heater core inlet-side channel B1 is connected to the inlet of the heater core 13. A shut-off valve 31,.which is opened and closed by the signals from an ECU 22, is located midway of the heater core inlet-side channel B1. One end of the heater core outlet-side channel B2 is connected to the outlet of the heater 13. The other end of the heart core outlet-side channel B2 is connected to a thermostat 8 which is located midway of the radiator outlet-side channel A2. A channel from the connection described above to the cylinder block 1*b* and the water jacket 23 are shared by the radiator outlet-side channel A2.

The circulation channel C has the main function of warming the engine 1 by accumulating heat of water coolant and emitting the stored heat.

The circulation channel C includes a regenerator inlet-side channel C1, a regenerator outlet-side channel C2, the regenerator 10, and the water jacket 23. The following is how the circulation channel C is connected. One end of the regenerator inlet-side side channel C1 is connected to a thermostat 8 which is located midway of the radiator outlet-side channel C2. A channel from the cylinder head 1*a* to the connection described above is shared by the circulation channel A and B. The other end of the regenerator inlet-side channel C1 is connected to the inlet of the regenerator 10. One end of the regenerator outlet-side channel C2 is connected to the outlet of the regenerator 10. The other end of the regenerator outlet-side channel C2 is connected to a point midway of the radiator inlet-side channel A1. The circulation channel C shares a part of the circulation channel A, B and the water jacket 23 in the engine 1. And check valves 11, which circulate water coolant only in the direction shown in FIG. 1, are located at the inlet and outlet of the regenerator 10. An in-regenerator water coolant temperature sensor 28, which transmits the signals according to temperature of the water coolant stored in the regenerator 10, is provided in the regenerator 10.

Furthermore, an electric water pump 12 is located midway of the regenerator inlet-side channel C1 and upstream-side of the check valve 11.

The circulation channel D has the main function of circulating water coolant until the water coolant reaches a predetermined temperature. The circulation channel D includes the water jacket 23 and a bypass channel 23*d*. One end of the bypass channel is connected to the outlet-side of the water jacket 23. On the other hand, the other end of the bypass channel 23*d* is connected to the inlet of the water pump 6 through the thermostat 8.

A water pump on the circulation channels according to the above description works as follows. Torque from a crankshaft (not shown) is transmitted to the input shaft of the water pump 6 when the engine 1 is running. Then the pump 6 spurts out water coolant driven by pressure according to the torque transmitted to the input shaft of the water pump 6. On the other hand, water coolant does not circulate in the circulation channel A when the engine 1 is turned off since the water pump 6 is turned off.

The water coolant spurted out of the water pump 6 circulates through the water jacket 23. At this time, heat is conducted through the cylinder head 1*a,* the interior of the cylinder block 1*b,* and the water coolant. Some of the heat generated by combustion in the cylinders (not shown) is conducted to the walls of the cylinders. Then the heat is conducted to the cylinder head 1*a* and the interior of the cylinder block 1*b*. As a result, temperatures at the cylinder heads 1*a* and the entire cylinder block rise. Some of the heat conducted to the cylinder head 1*a* and the cylinder block 1*b* is conducted to the water coolant in the water jacket 23. Then the temperature of the water coolant is raised. As a result, temperatures at the cylinder head 1*a* and the cylinder block 1*b* drop due to heat loss. As described above, the temperature of the water coolant is raised and the water coolant flows out to the radiator inlet-side channel A1 from the cylinder block.

The water coolant, which flows out to the radiator inlet-side channel A1, flows into the radiator 9 after flowing through the radiator inlet-side channel A1. At this time, heat is conducted to outside air from the water coolant. Some of the heat of the high-temperature water coolant is conducted to the walls of the radiator 9. And the heat is conducted to the interior of the radiator 9 which leads to raising the temperature of the entire radiator 9. Then some of the heat, which is conducted to the radiator 9, is conducted to outside air. As a result, the temperature of the outside air rises. And the temperature of the water coolant drops due to heat loss. The lower-temperature water coolant flows out of the radiator 9.

The water coolant, which flows out of the radiator 9, reaches the thermostat 8 after flowing through the radiator outlet-side channel A2. When the water coolant, which flows through the heater core outlet-side channel B2, reaches a predetermined temperature, wax expands to a certain extent. Then the thermostat 8 opens automatically by the heat expanding of the wax. In other words, the radiator outlet-side channel A2 is shut off when the water coolant, which flows through the heater core outlet-side channel B2, does not reach a predetermined temperature. As a result, the water coolant in the radiator outlet-side channel A2 cannot pass the thermostat 8.

The water coolant, which passes through the thermostat 8, flows into the water pump 6 when the thermostat 8 is open.

As described above, the thermostat 8 opens and water coolant circulates in the radiator 9 only when the water coolant reaches a predetermined temperature. The lower-temperature water coolant, which flows through the radiator 9, is spurted out of the water pump 6 to the water jacket 23. Then the temperature of the water coolant rises again.

In the meantime, some of the water coolant, which flows through the radiator inlet-side channel A1, flows into the heater core inlet-side channel B1.

The water coolant, which flows into the heater core inlet-side channel B1, reaches the shut-off valve 31 after flowing through the heater core inlet-side channel B1. The shut-off valve 31 is operated by the signals from the ECU 22. The valve is open when the engine 1 is running and the valve is closed when the engine 1 is turned off. The water coolant reaches the heater core 13 after passing the shut-off valve 31 and flowing through the heater core inlet-side channel B1 when the engine 1 is running.

The heater core 13 exchanges heat with air in a compartment. The air warmed by the heat conduction circulates in the compartment by a fan (not shown). As a result, ambient temperature in the compartment rises. Then the water coolant merges into the radiator outlet-side channel A2 after flowing out of the heater core 13 and flowing through the heater core outlet-side channel B2. At this time, the water coolant flows into the water pump 6 after merging with the water coolant in the circulation channel A when the thermostat 8 is open. On the other hand, the water coolant, which flows through the circulation channel B, flows into the water pump 6 when the thermostat 8 is closed.

As described above, the water coolant, which drops its temperature after flowing through the heater core 13, is spurted out of the water pump 6 to the water jacket 23 again.

In this connection, it is necessary that water coolant temperature be raised rapidly when the temperature of the water coolant is lower than a predetermined temperature. In this case, the water coolant drops its temperature when flowing through radiator. Therefore, it is possible that the water coolant does not reach the predetermined temperature; otherwise it takes a while for the water coolant to reach the predetermined temperature. To prevent the above-mentioned status, the thermostat 8 is provided so that the water coolant does not circulate in the radiator 9 and drop its temperature since the thermostat 8 is automatically closed. And coolant does not circulate in the heater core 13 if the shut-off valve is kept closed. Furthermore, low-temperature water coolant does not reversely flow into the regenerator 10 since the regenerator 10 is located between the check valves 11.

As described above, only the circulation channel D can circulate water coolant when the water coolant temperature is low. The water coolant, which circulates through the circulation channel D, is supplied heat from the engine 1. Then the temperature of the water coolant rises gradually. The thermostat 8 automatically opens and the water coolant emit its heat through the radiator 9 when water coolant temperature detected by the signals from the in-engine water coolant temperature sensor is above a predetermined temperature.

As described above, water coolant temperature can be kept approximately constant since water coolant circulates in the circulation channel D when water coolant temperature is low and water coolant circulates in the circulation channel A when water coolant reaches a predetermined temperature.

The engine 1 formed according to the above description has the electronic control unit (ECU hereafter) 22 to control the engine 1. This ECU 22 controls running status of the engine 1 according to running conditions of the engine 1 and requirements from a user. The ECU 22 also has the function of temperature raising control (engine-preheating control) when the engine 1 is turned off. The ECU 22 is connected to various sensors such as a crank position sensor, the in-regenerator water coolant temperature sensor 28 and the in-engine water coolant temperature sensor 29. These sensors are connected to the ECU 22 through electrical wiring so that output signals from the sensors can be inputted to the ECU 22.

Furthermore, the ECU 22 is connected through electrical wiring with various components in the engine 1 such as the electric water pump 12, the shut-off valve 31, the shut-off valve 38, and a shut-off valve 39 to control these components.

Figure 2:
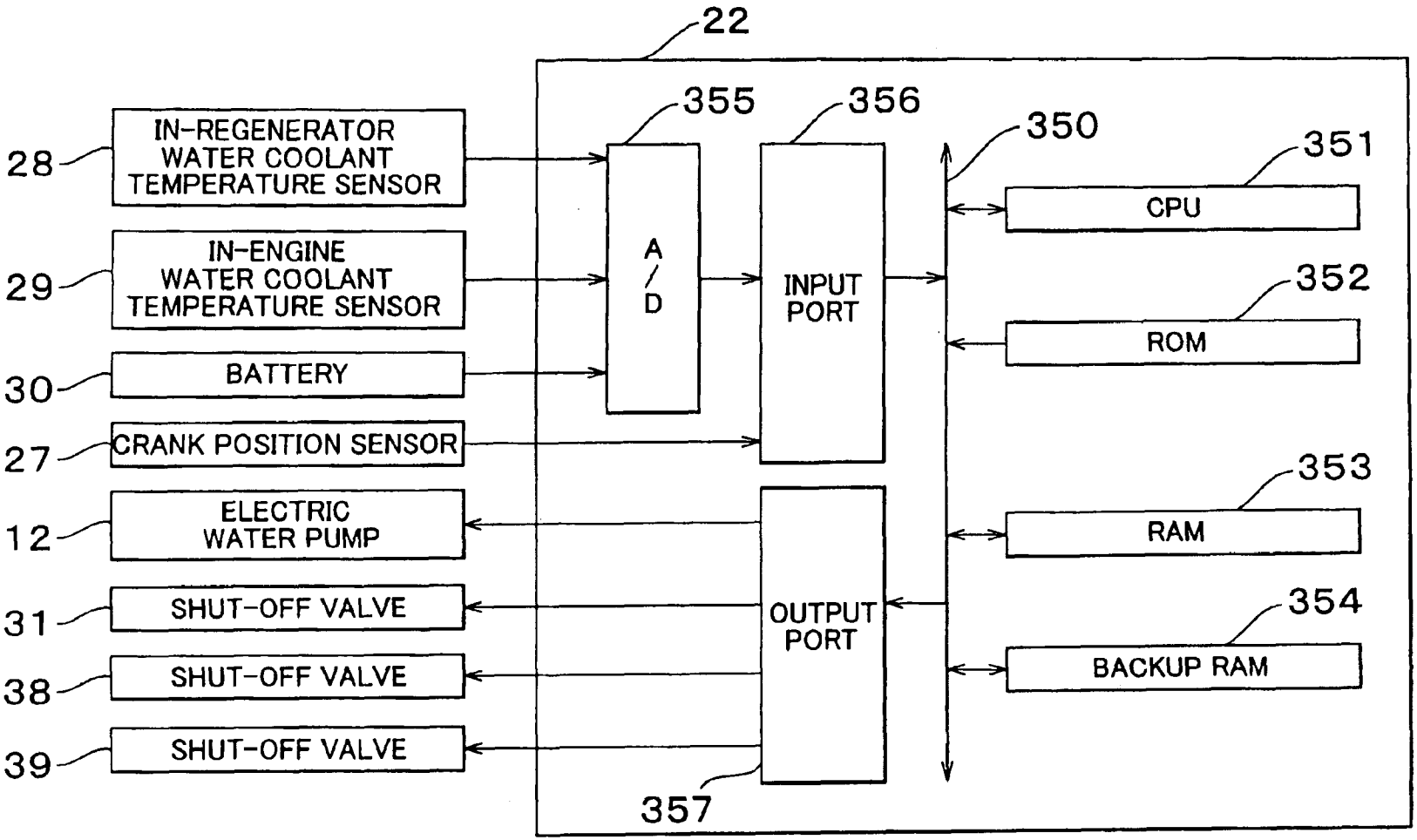
FIG. 2 is a block diagram which shows internal components of an ECU.

As shown in FIG. 2, the ECU 22 is equipped with a CPU 351, a ROM 352, a RAM 353, a backup RAM 354, an input port 356, and an output port 357 all of which are connected each other by a bi-directional bus 350. The input port 356 is connected to an A/D converter 355 (A/D 355 hereafter).

The input port 356 inputs output signals from sensors such as the crank position sensor 27 which outputs digital signals. Then the input port 356 transfers these signals to the CPU 351 and the RAM 353.

The input port 356 inputs output signals through the A/D 355 which outputs analog signals such as the in-regenerator water coolant temperature sensor 28, the in-engine water coolant temperature sensor 29, and a battery 30. Then the input port 356 transfers these signals to the CPU 351 and the RAM 353.

The output port 357 is connected through electrical wiring with various components in the engine 1 such as the electric water pump 12, the shut-off valve 31, the shut-off valve 38, and the shut-off valve 39. And the output port 357 transfers the control signals outputted from the CPU 351 to the above-mentioned components such as the electric water pump 12, the shut-off valve 31, the shut-off valve 38, and the shut-off valve 39.

The ROM 352 stores application programs such as engine preheat-controlling routine to supply heat from the regenerator 10 to the engine 1.

In addition to the above-mentioned application program, the ROM 352 stores various control maps such as fuel injection-controlling map which shows relation between running status of the engine 1 and basic fuel injection amount (basic fuel injection time). The following two control maps can be presented as other examples of control maps. Fuel injection timing-controlling map shows relation between running status of the engine 1 and basic fuel injection timing. And shut-off valve control map shows relation between water coolant temperature and opening and closing status of the shut-off valves 31,38, and 39.

The RAM 353 stores output signals from each sensor, arithmetic result from the CPU 351 and so on. Engine revolution calculated according to pulse signal intervals from the crank position sensor 27 can be presented as an example of arithmetic result. Data are updated whenever the crank position sensor outputs pulse signals.

The RAM 354 is nonvolatile memory which can store data even if the engine 1 is turned off.

The following explains summary of temperature raising control (engine-preheating control hereafter) of the engine 1 according to the present embodiment.

When the engine 1 is running, the ECU 22 transfers signals to the electric water pump 12 to start the pump. Then water coolant circulates in the circulation channel C.

Some of the water coolant, which flows through the heater core outlet-side channel B2, flows into the regenerator inlet-side channel C1. The water coolant, which flows into the regenerator inlet-side channel C1, reaches the electric water pump 12 after flowing through the regenerator inlet-side channel C1. The electric water pump 12 is driven according to the signals from the ECU 22 and spurts out water coolant with a predetermined pressure.

The water coolant, which is spurted out of the electric water pump 12, reaches the regenerator 10 after flowing through the regenerator inlet-side channel C1 and passing the check valve 11. The regenerator 10 has evacuated heat insulation space between the exterior of a container 10*a* and the interior of a container 10*b*. And the water coolant, which flows in through a water coolant injection tube 10*c*, flows out of a water coolant extraction tube 10*d*.

The water coolant, which flows into the regenerator 10, is insulated from outside. The water coolant, which flows out of the regenerator 10, flows into the radiator inlet-side channel A1 after passing the check valve 11 and flowing through the regenerator outlet-side channel C2.

As described above, the water coolant, whose temperature is raised by the engine 1, flows through the interior of the regenerator 10. And the interior of the regenerator 10 is filled with high-temperature water coolant. Then the high-temperature water coolant can be stored in the regenerator 10 when the ECU 22 stops operating the electric water pump 12 after the engine 1 is turned off. By the insulation effect of the regenerator 10, dropping temperature of the stored water coolant is restrained. The ECU 22 also performs engine-preheating control of the cylinder head 1 a by circulating the high-temperature water coolant, which is stored in the regenerator 10, in the circulation channel C.

Figure 3:
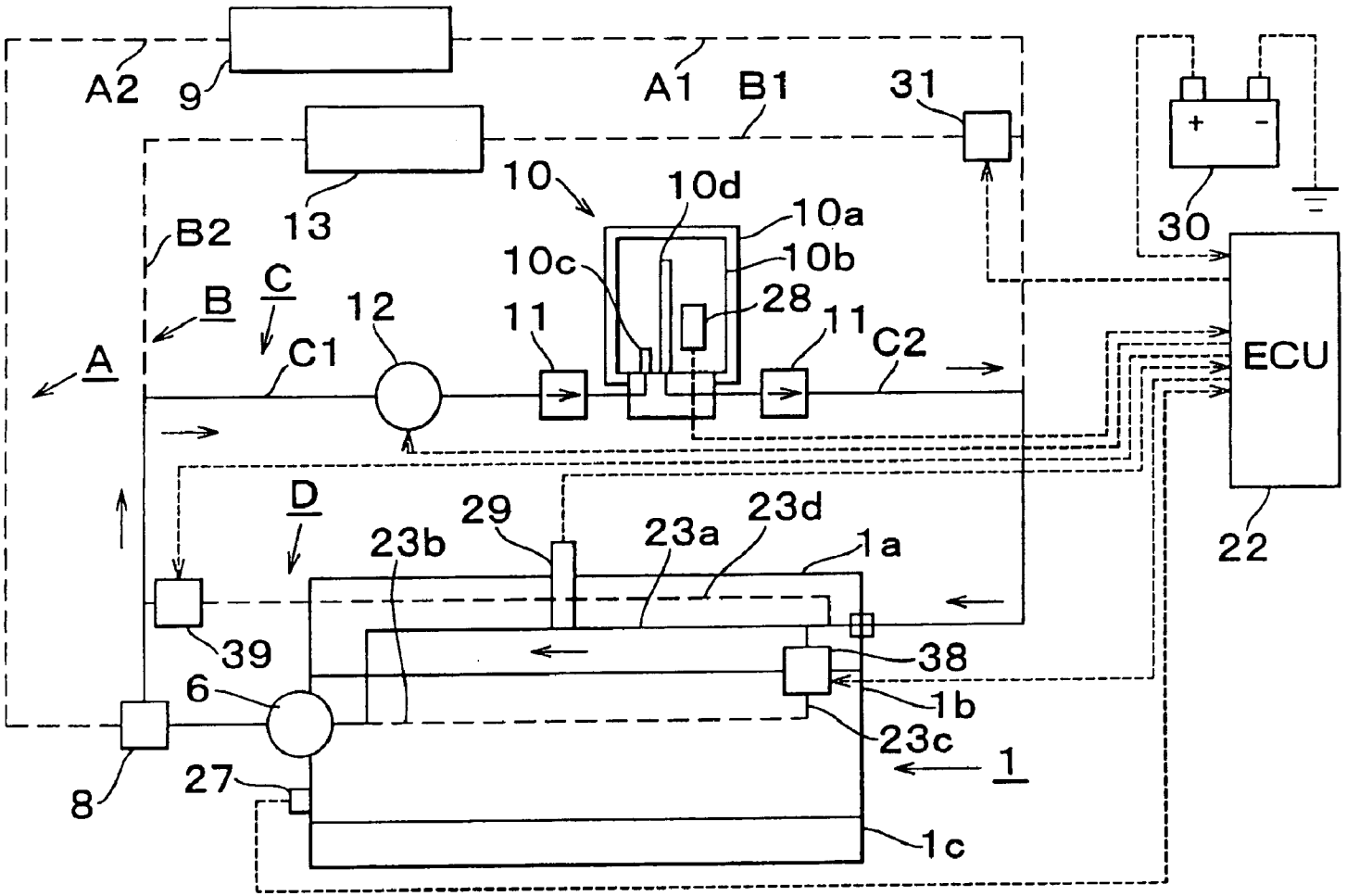
FIG. 3 is a view of the circulation directions of water coolant when engine-preheat is controlled according to the first embodiment.

FIG. 3 shows the water coolant circulation channels and the circulation directions of water coolant when heat from the regenerator 10 is supplied to the engine 1 and the engine 1 is turned off.

The water coolant circulation in the head-side water jacket 23*a* when heat is supplied to the engine 1 from the regenerator is in the opposite direction to the water coolant circulation when the engine 1 is running.

The shut-off valve 31, the shut-off valve 38, and the shut-off valve 39 are closed by the ECU 22 when the engine-preheating control is performed. The electric water pump 12 is driven according to the signals from the ECU 22 and spurts out water coolant with a predetermined pressure. The spurted out water coolant reaches the regenerator 10 after flowing through the regenerator inlet-side channel C1 and passing the check valve 11. At this time, the water coolant, which flows into the regenerator 10, is the water coolant whose temperature is lowered when the engine 1 is turned off.

The water coolant, which is stored in the regenerator 10, flows out of the regenerator 10 through the water coolant extraction tube 10*d*. At this time, the water coolant, which flows out of the regenerator 10, is the water coolant which is insulated by the regenerator 10 after flowing into the regenerator 10 when the engine 1 is running. The water coolant, which flows out of the regenerator 10, flows into the cylinder head 1*a* after passing the check valve 11 and flowing through the regenerator outlet-side channel C2. When the engine 1 is turned off, water coolant does not circulate in the heater core 13 since the shut-off valve 31 is closed according to the signal from the ECU 22. And when water coolant temperature is higher than the opening valve temperature of the thermostat 8, it is not necessary to supply heat from the regenerator 10 to the engine 1. In other words, when water coolant circulates and the engine 1 is turned off, the thermostat 8 is always closed. Therefore, the water coolant temperature does not drop due to heat conduction since water coolant does not circulate in the heater core 13 and the radiator 9.

The water coolant, which flows into the cylinder head 1*a*, flows through the head-side water jacket 23*a*. The cylinder head 1*a* exchanges heat with the water coolant in the head-side water jacket 23. Some of the heat from the water coolant is conducted to the interior of the cylinder head 1*a* and the temperature of the entire cylinder head 1*a* rises. As a result, the temperature of the water coolant drops due to heat loss. At this time, the water coolant does not flow into the block-side water jacket 23*b* since the shut-off valve is closed by the signal from the ECU 22 when the engine 1 is turned off. Therefore, the water coolant temperature does not drop in the cylinder block 1*b* due to heat conduction. Furthermore, water coolant does not circulate in the bypass channel 23*d* since the shut-off valve 39 is closed by the signal from the ECU 22 when the engine is turned off. Therefore, water coolant always conducts heat in the head-side water jacket 23*a* before returning to the regenerator 10.

Then the water coolant, whose temperature is lowered by heat conduction in the head-side water jacket 23*a*, reaches the electric water pump 12 after flowing out of the cylinder block 1*b* and flowing through the regenerator inlet-side channel C1.

As described above, the ECU 22 performs the engine-preheating control of the cylinder head 1*a* by activating the electric water pump 12 prior to starting the engine 1.

In this connection, the water coolant (heated water), which is stored in the regenerator 10, is supplied to not only the cylinder head 1*a* but also to the cylinder block 1*b* according to the system applying to the present embodiment, in other words, heat-exchanging system between the engine 1 and the regenerator 10 by circulating the water coolant in both the engine 1 and the regenerator 10. Therefore, unnecessary heat is supplied to cylinder block 1*b* which increases heat consumption in the regenerator 10. Then the heat stored in the regenerator 10 is consumed in a short period due to the increased heat consumption. Therefore, the period of possible warming up the cylinder head 1*a* is shortened.

To obviate the above-mentioned problem, the shut-off valve closes not to circulate water coolant into the cylinder block 1*b* when heat supply is carried out according to the present embodiment. Unnecessary heat consumption can be decreased when water coolant does not circulate into the cylinder block 1*b*. Therefore, the period of possible supplying heat to the cylinder head 1*a* can be lengthened.

The following explains the control flow when the above-described engine-preheating control is performed.

The FIG. 4 is the flow chart which shows the flow of the engine-preheating control. At a step S101, the ECU 22 is activated and starts performing the present control when a trigger signal is inputted in the ECU 22. Door opening and closing signals of a driver's-side door transmitted from a door opening and closing sensor (not shown) can be presented as an example of a trigger signal. To start the engine 1 installed on a vehicle, a driver naturally opens a door to get in a vehicle before starting the engine. Therefore, the ECU 22 is connected to a door opening and closing sensor so that the ECU 22 is activated and start performing the engine-preheating control when the door opening and closing sensor detects that the door is opened. Then the engine is warmed up when the driver starts the engine 1.

At a step S102, the CPU 351 closes the shut-off valves 31, 38, and 39 by transmitting signals to these valves.

At a step S103, whether the engine-preheating performing conditions are met is determined. Output signals of the in-engine water coolant temperature sensor 29 are utilized as a factor for the determining. The CPU 351 calculates water coolant temperature in the water jacket 23 Tw. Then the CPU 351 determines whether the calculated temperature is lower than a predetermined temperature (45° C., for example). When the CPU 351 determines that the calculated temperature is lower than the predetermined temperature, that leads to going to a step S104 to circulate water coolant into the engine 1. When the CPU 351 determines otherwise, that leads to going to a step S109 without circulating water coolant.

At this time, in other words, when the temperature in the water jacket 23 is higher than the predetermined temperature (45° C., for example), the engine-preheating of the engine 1 is not performed due the following two reasons.

The first reason is that it is not effective to circulate water coolant. The second reason is that power consumption needs to be decreased. The electric power to operate the electric water pump 12 is supplied from the battery 30 installed in the vehicle. However, the amount of electric power is limited. Therefore, it is important to decrease power consumption.

At the step S104, the CPU 351 inputs output signals from the in-regenerator water coolant temperature sensor 28 by accessing RAM 353.

At a step S105, the CPU determines the operating time of the electric water pump 12 Tpt according to output signals from the in-regenerator water coolant temperature sensor 28. The output signals from the in-regenerator water coolant temperature sensor 28 and the operating time of the electric water pump 12 are turned into maps beforehand and the maps are stored in the ROM 352. The CPU 351 calculates the operating time of the electric water pump 12 according to the output signals from the in-regenerator water coolant temperature sensor 28 and the maps. The calculation result is stored in the RAM 353.

At a step S106, the CPU 351 activates the electric water pump 12 by supplying electric power to the electric water pump 12.

At a step S107, the CPU 351 determines whether the calculated time at the step S105 passes or not since the electric water pump 12 is activated at the step S106. The CPU 351 detects the elapsed time since the electric water pump 12 is activated by accessing the RAM 353. When the elapsed time is longer the calculated time at the step 105, that leads to going to a step S108. When the elapsed time is shorter the calculated time at the step 105, that leads to going to the step S106 and the electric water pump 12 is operated continuously.

At the step S108, the CPU 351 stops operating the electric water pump 12.

At the step S109, the CPU 351 determines whether the engine 1 is started or not. CPU 351 can determine whether the engine 1 is started or not by accessing RAM 353 and receiving output signals from the crank position sensor 27. When the CPU 351 determines that the engine 1 is running, that leads to going to a step S113. The water coolant circulation in the head-side water jacket 23 when the engine 1 is running is in the opposite direction to the water coolant circulation when the engine 1 is turned off since the water pump 6 starts spurting out water coolant when the engine 1 is started. On the other hand, when the CPU 351 determines that the engine 1 is not running, that leads to going to a step S110 due to the possibility that warming up the engine 1 again is necessary after the temperature of the engine 1, which is warmed up from the step S106 through the step S108, is lowered.

At the step S110, the CPU 351 determines whether the voltage of the battery 30 is higher than a predetermined voltage (12V, for example) of not. When the CPU 351 determines that the voltage of the battery 30 is higher than the predetermined voltage, that leads to going to a step S111. When the CPU 351 determines otherwise, that leads to going to the step S109 without activating the electric water pump 12 due to the following reason. The reason is that if the electric water pump 12 is activated in this case, the voltage of the battery 30 falls further so that it is difficult to start the engine 1.

At the step S111, the CPU 351 inputs output signals from the in-regenerator water coolant temperature sensor 28 and the in-engine water coolant temperature sensor 29 by accessing RAM 353.

At a step 112, the CPU 351 determines whether the performing conditions of preheating the engine 1 again are met. Output signals from the in-regenerator water coolant temperature sensor 28 and the in-engine water coolant temperature sensor 29 are utilized as factors for the determining. The CPU 351 calculates water coolant temperature in the water jacket 23 Tw. Then the CPU 351 determines performing condition 1 which is whether the calculated temperature is lower than a predetermined temperature (30° C., for example). Also, the CPU 351 determines performing condition 2 which is whether water coolant temperature in the regenerator 10 Tth is higher than the water coolant temperature in the water jacket 23 Tw according to the output signals from the in-regenerator water coolant temperature sensor 28 and the in-engine water coolant temperature sensor 29. When the CPU determines that both two performing conditions are met, that leads to going to the step S105 to warm up the engine 1. When the CPU determines otherwise, that leads to going to the step S109 without circulating water coolant. When the CPU determines that both two performing conditions are not met, it is not effective to circulate water coolant. Water coolant temperature in the water jacket 23 Tw and temperature in the engine 1 falls if the water coolant temperature in the regenerator 10 Tth is higher than the water coolant temperature in the water jacket 23 Tw and the electric water pump 12 is activated. To avoid this status, activation of the electric water pump 12 is not provided at this step.

At the step S113, the CPU 351 opens the shut-off valve 39 by transferring signals to the valve. The water pump 6 starts spurting out water coolant when the engine 1 is started. If the shut-off valve is opened at this time, the water coolant flow through the bypass channel 23*d* and circulates in the circulation channel D. At a step S114, whether a switch of a blower for a heater (not shown) is on is determined. At this time, water coolant does not circulate in the heater core 13 since the shut-off valve 31 is closed. At this time, air, which is not supplied heat from the heater core 13, passes the heater core 13 without being warmed even the blower for the heater is activated. Therefore, temperature in a compartment does not rise. To avoid this status, water coolant circulates in the heater core 13 by opening the shut-off valve 31. When the CPU 351 determines that the switch of the blower for the heater (not shown) is on, that leads to going to a step S115. When the CPU 351 determines otherwise, that leads to going to a step S117.

At the step S115, the CPU 351 determines whether water coolant temperature in the water jacket 23 Tw is higher than a predetermined temperature according to the output signals from the in-engine water coolant temperature sensor 29. When this condition is met, that leads to going to a step S116 to supply heat to the heater core 13. When this condition is not met, that leads to going to the step S114. Then water coolant does not circulate in the heater core 13 since it is not effective to circulate water coolant.

At the step S116, the CPU 351 opens the shut-off valve by transferring signals to the valve. Water coolant circulates in the circulation channel B, when the shut-off valve is open. At this time, the water coolant does not circulate in the circulation channel A since the coolant temperature is not reaching the opening valve temperature of the thermostat 8.

At the step S117, the CPU 351 determines whether water coolant temperature in the water jacket 23 Tw is higher than a predetermined temperature according to the output signals from the in-engine water coolant temperature sensor 29. When this condition is met, that leads to going to a step S118. When this condition is not met, that leads to going to the step S114 to circulate water coolant in the head-side water jacket 23*a* intensively to raise the water coolant temperature.

At the step S118, the CPU 351 opens the shut-off valve 38 by transferring signals to the valve. At this time, drawbacks such as deterioration of exhaust gas emission due to low-temperature water coolant has been improved since the water coolant temperature in the cylinder head 1*a* is raised sufficiently. When the shut-off valve 38 is open, water coolant circulates in the cylinder block 1*b* and the water coolant exchanges heat with the entire engine 1.

Then the engine-preheating control is finished, and normal running control is started. As explained above, intensive raising temperature of the cylinder head 1*a* is possible by opening and closing the shut-off valves 31,38,and 39 when the engine 1 is turned off according to the present embodiment. Therefore, keeping raising temperature of the cylinder head 1*a* for a long period is possible by raising temperature of a part such as the cylinder block 1*b* where raising temperature is less needed and restraining heat consumption in the regenerator 10.

Furthermore, the amount of heat accumulated in the regenerator 10 can be decreased since the heat accumulated in the regenerator 10 can be utilized effectively. Therefore, downsizing the regenerator 10 and shortening time to supply heat is possible.

The Second Embodiment

The following is the differences between an engine 1 equipped with the regenerator 10 according to the present embodiment and the engine 1 according to the first embodiment.

All the shut-off valves 31,38,and 39 are electromagnetic valves which open and close according to the signals from the CPU 351 according to the first embodiment. On the other hand, a check valve 41, which passes water coolant only in one direction, is provided instead of the shut-off valve 38 according to the second embodiment.

Figure 5:
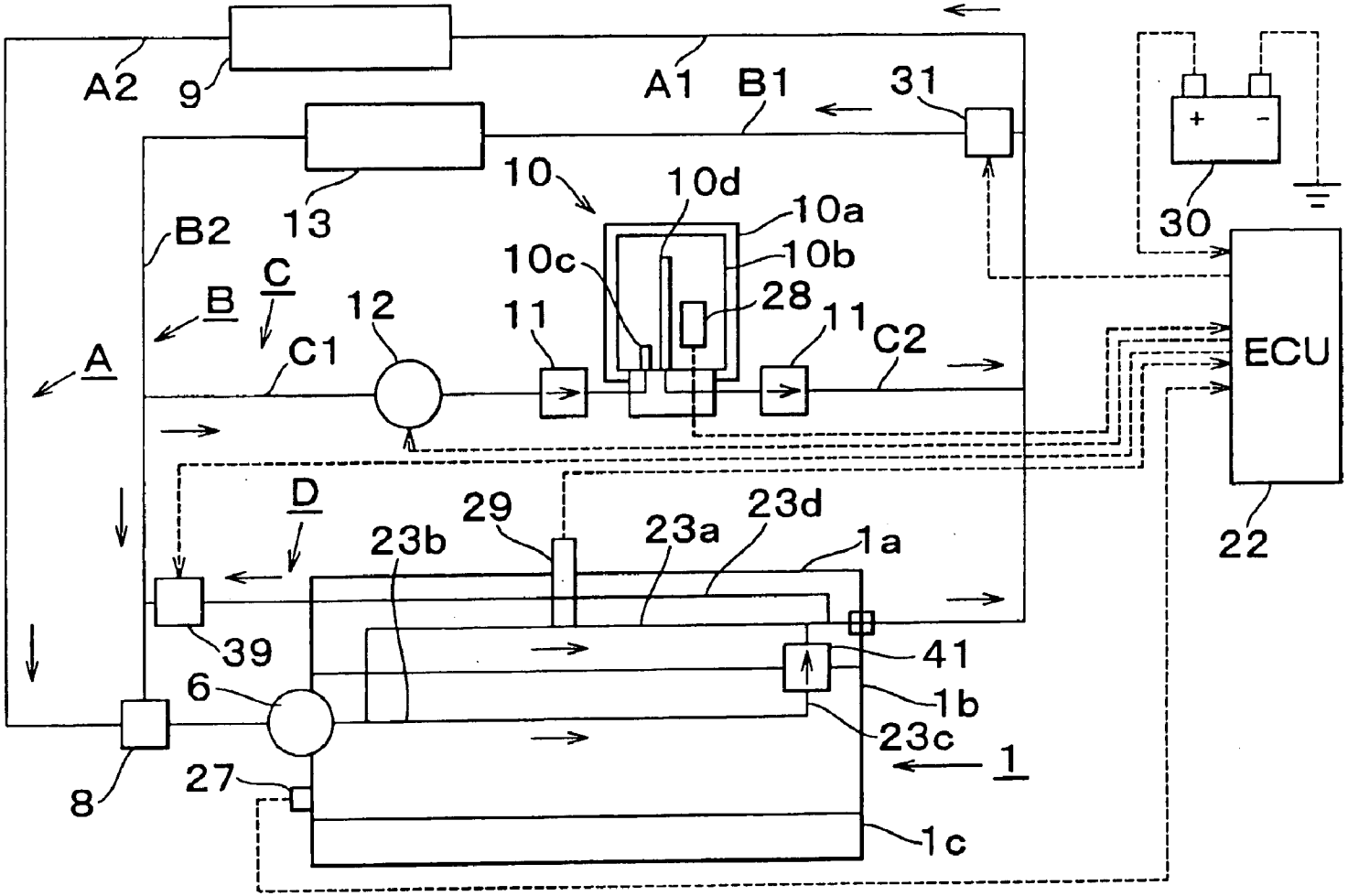
FIG. 5 is a schematic view of an engine applying to the regenerator of the internal combustion engine according to the second embodiment and cooling channels in which water coolant circulates.

As shown in FIG. 5, water coolant can pass from cylinder block 1*b* to the cylinder head 1*a*.

The following is how water coolant circulates in the engine 1 with the regenerator 10 formed according to the above description. Water coolant circulates in the head-side water jacket 23*a*, the connecting channel 23*c*, the block-side water jacket 23*b*, and the bypass channel 23*d* when the engine 1 is running since the water coolant circulates in the directions of the arrows shown in FIG. 5. In this case, the water coolant, which flows through the connecting channel 23*c*, can pass the check valve 41.

On the other hand, water coolant circulates in the directions of the arrows shown in FIG. 3 when the engine 1 is turned off and heat needs to be supplied to the engine 1 by circulating water coolant. The water coolant, which flows into the cylinder head 1*a* from the radiator inlet-side channel A1, does not flow through the bypass channel 23*d* since the shut-off valve is closed. And water coolant does not pass the check valve 41 and flow into the block-side water jacket 23*b* since the circulation direction of the water coolant is opposite to the allowable circulation direction of the check valve 41. The basic composition relating to other hardware is substantially identical to the basic composition relating to other hardware according to the first embodiment. Therefore, the explanation of the basic composition relating to other hardware is omitted.

According to the present embodiment, the shut-off valves 31 and 39 are closed at a step corresponding to the step S102 in the flow chart shown in FIG. 4 according to the first embodiment. And it is not necessary to perform the controls at the steps S117 and S118.

As described above, simplifying controls and devices is possible since the number of the shut-off valves which need to be controlled is less than the number of the ones in the engine 1 with the regenerator 10 according to the first embodiment.

As described above, intensive raising temperature of the cylinder head 1*a* is possible by opening and closing the shut-off valves 31 and 39 when the engine 1 is turned off according to the present embodiment. Therefore, keeping raising temperature of the cylinder head 1*a* for a long period is possible by raising temperature of a part such as the cylinder block 1*b* where raising temperature is less needed and restraining heat consumption in the regenerator 10.

Furthermore, the amount of heat accumulated in the regenerator 10 can be decreased since the heat accumulated in the regenerator 10 can be utilized effectively. Therefore, downsizing the regenerator 10 and shortening time to supply heat is possible.

The check valve 41 can be replaced by a pressure-sensing valve or a thermostat valve according to the present embodiment.

A pressure-sensing valve opens when a difference in pressure before and after the pressure-sensing valve reaches no less than a predetermined value. If a pressure-sensing valve is utilized according to the present embodiment, the valve has to meet the following conditions. The first condition is that a differential pressure before and after the pressure-sensing valve when the electric water pump 12 is activate and engine 1 is turned off is smaller than an open valve differential pressure of the pressure-sensing valve. The second condition is that a differential pressure before and after the pressure-sensing valve when the engine 1 is running is larger than an open valve differential pressure of the pressure-sensing valve. In other words, a pressure-sensing valve which opens automatically when heat is supplied from the regenerator 10 and opens automatically when the engine 1 is running. A pressure-sensing valve which meets the above conditions is as effective as the check valve 41.

On the other hand, a thermostat valve opens at temperatures no less than a predetermined temperature. If a thermostat valve is utilized according to the present embodiment, the valve has to meet the following condition. The condition is that the thermostat does not completely close even when water coolant temperature is low. Then a small amount of water coolant can pass the thermostat. As a result, the thermostat valve does not open and a small amount of water coolant flows into the block-side water jacket 23*b* when the engine 1 is turned off and heat is supplied from the regenerator 10 since the water coolant with lower temperature than an open valve temperature of the thermostat circulates. At this time, the amount of heat supplied to the cylinder block 1*b* is restrained since a small amount of water coolant flows through the block-side water jacket 23*b*. Then the water coolant temperature, which passes the thermostat valve, rises when the engine 1 is started and water coolant temperature rises. As a result, thermostat valve automatically opens and a large amount of water coolant flows through the block-side water jacket 23*b*. As described above, a thermostat which meets the above condition is as effective as the check valve 41.

Furthermore, the shut-off valve 31 can be replaced by a thermostat valve according to the present embodiment. The open valve temperature of the thermostat should be set lower than the open valve temperature of the thermostat 8.

The Third Embodiment

The following is the differences between an engine 1 equipped with the regenerator 10 according to the present embodiment and the engine 1 according to the first embodiment.

All the shut-off valves 31,38,and 39 are electromagnetic valves which open and close according to the signals from the CPU 351 according to the first embodiment. On the other hand, a check valve 42, which passes water coolant only in one direction, is provided instead of the shut-off valve 38 according to the third embodiment.

Figure 6:
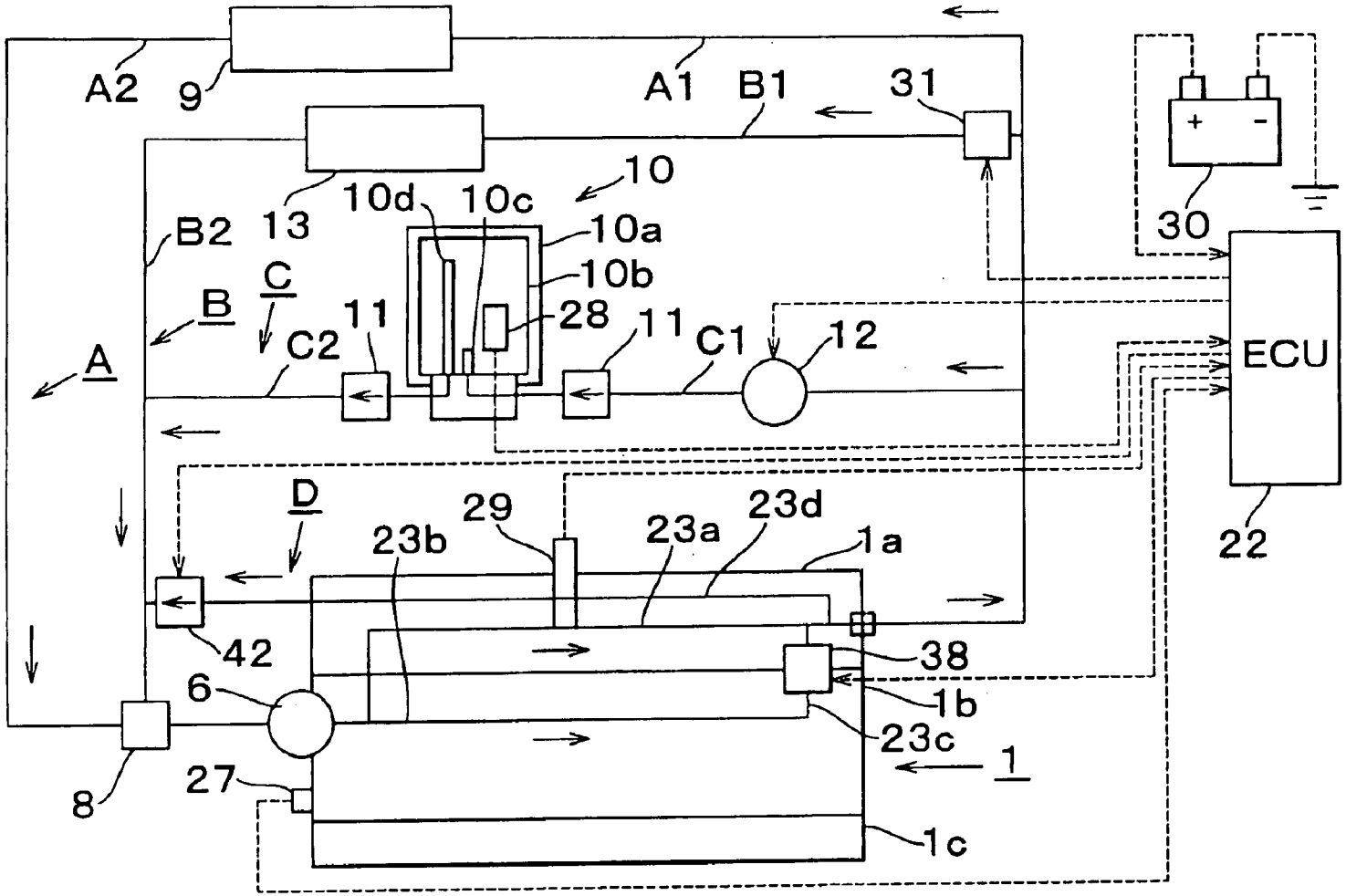
FIG. 6 is a schematic view of an engine applying to the regenerator of the internal combustion engine according to the third embodiment and cooling channels in which water coolant circulates.

As shown in FIG. 6, water coolant, which flows into the bypass channel 23*d*, can pass from the cylinder block 1*b* to the heater core outlet-side channel B2.

According to the present embodiment, the circulation direction of the water coolant, which flows through the circulation channel C, reverses when heat is supplied to the engine 1 from the regenerator 10. In other words, the water coolant in the water jacket 23, when the engine 1 is running, flows in the same direction of the water coolant in the water jacket 23 when heat is supplied from the regenerator 10.

The circulation channel C includes the regenerator inlet-side channel C1, the regenerator outlet-side channel C2, and the regenerator 10. The following is how the circulation channel C is connected. One end of the regenerator inlet-side channel C1 is connected to a point midway of the radiator inlet-side channel A1. A channel from the cylinder head 1*a* to the connection described above is shared by the circulation channel A and B. One end of the regenerator outlet-side channel C2 is connected to the outlet of the regenerator 10. The other end of the regenerator outlet-side channel C2 is connected to a point midway of the radiator outlet-side channel A2.

The basic composition relating to other hardware is substantially identical to the basic composition relating to other hardware according to the first embodiment. Therefore, the explanation of the basic composition relating to other hardware is omitted.

In the engine 1 with the regenerator 10, which is formed according to the above description, some of the water coolant, which flows through the radiator inlet-side channel A1, flows into the regenerator inlet-side channel C1 when the electric water pump is operated. The water coolant, which flows into the regenerator inlet-side channel C1, reaches the electric water pump 12 after flowing through the regenerator inlet-side channel C1. The electric water pump 12 is driven according to the signals from the ECU 22 and spurts out water coolant with a predetermined pressure.

Then the water coolant is spurted out of the electric water pump 12 and reaches the regenerator 10 after flowing through the regenerator inlet-side channel C1 and passing the check valve 11.

Then the water coolant, which flows out of the regenerator 10, flows into the heater core outlet-side channel B2 after passing the check valve and flowing through the regenerator outlet-side channel C2.

Water coolant circulates in the head-side water jacket 23*a*, the connecting channel 23*c*, the block-side water jacket 23*b*, and the bypass channel 23*d* when the engine 1 is running since the water coolant circulates in the directions of the arrows shown in FIG. 6. In this case, the water coolant, which flows through the connecting channel 23*d*, can pass the check valve 42.

Figure 7:
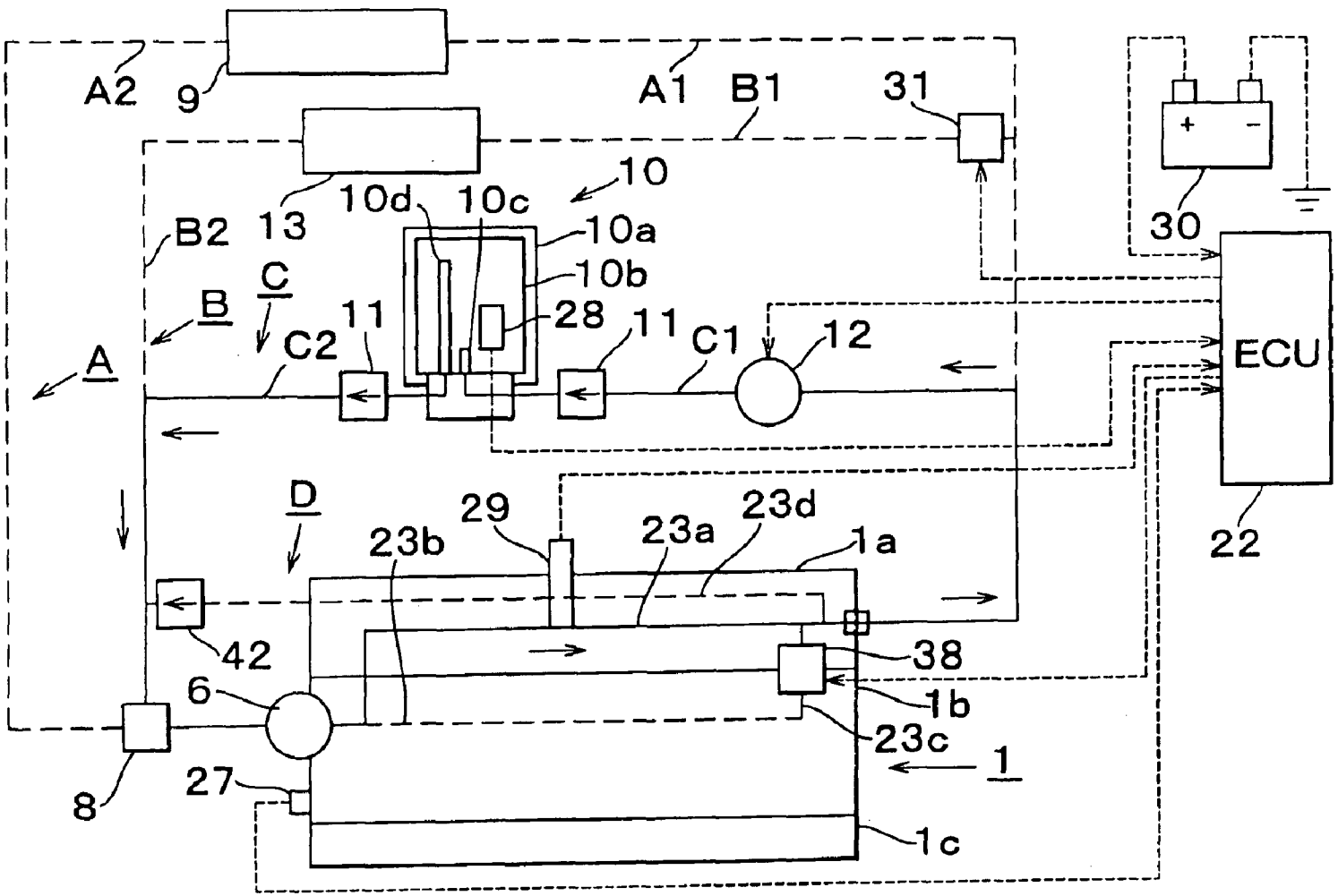
FIG. 7 is a view of the circulation directions of water coolant when engine-preheat is controlled according to the third embodiment.

FIG. 7 shows the circulation directions of water coolant when the engine is turned off and water coolant needs to be circulated to supply heat. Water coolant circulates in the directions of the arrows.

The water coolant, which flows through the heater core outlet-side B2, cannot pass the check valve 42 since the water coolant reaches from the direction opposite to the allowable circulation direction of the check valve 42. The water coolant, which flows into the cylinder block 1*b* from the heater core outlet-side channel B2, flows through the head-side water jacket 23*a* and supply heat to the cylinder head 1*a*. At this time, water coolant does not flow into the block-side water jacket 23*b* since the shut-off valve 38 is closed.

The water coolant, which supplies heat to the cylinder head 1*a*, reaches the electric water pump 12 after flowing through the radiator inlet-side channel A1. At this time, water coolant does not flow into the heater core 13 and drop its temperature since the shut-off valve 31 is closed. And water coolant does not pass the radiator 9 and drop its temperature since the thermostat 8 is closed.

According to the present embodiment, the shut-off valves 31 and 38 are closed at a step corresponding to the step S102 in the flow chart shown in FIG. 4 according to the first embodiment. And it is not necessary to perform the control at the step S113.

As described above, simplifying controls and devices is possible since the number of the shut-off valves which need to be controlled is less than the number of the ones in the engine 1 with the regenerator 10 according to the first embodiment.

As described above, intensive raising temperature of the cylinder head 1*a* is possible by opening and closing the shut-off valves 31 and 38 when the engine 1 is turned off according to the present embodiment. Therefore, keeping raising temperature of the cylinder head 1*a* for a long period is possible by raising temperature of a part such as the cylinder block 1*b* where raising temperature is less needed and restraining heat consumption in the regenerator 10.

Furthermore, the amount of heat accumulated in the regenerator 10 can be decreased since the heat accumulated in the regenerator 10 can be utilized effectively. Therefore, downsizing the regenerator 10 and shortening time to supply heat is possible.

Like the second embodiment, the check valve 42 can be replaced by a pressure-sensing valve or a thermostat valve according to the present embodiment.

Furthermore, the shut-off valve 31 can be replaced by a thermostat valve according to the present embodiment. The open valve temperature of the thermostat should be set lower than the open valve temperature of the thermostat 8.

The Fourth Embodiment

The following is the differences between an engine 1 equipped with the regenerator 10 according to the present embodiment and the engine 1 according to the first embodiment.

According to the first embodiment, the circulation channel C and the circulation channel D are independent of each other except that these two circulation channels share a section. On the other hand, a circulation channel C and a circulation channel D completely share each other so that the whole these two circulation channels are common. In other words, the circulation channel C according to the first embodiment also has the function of the circulation channel D.

In the engine 1 with the regenerator 10, which is formed according to the above description, water coolant circulates in the head-side water jacket 23*a*, the connecting channel 23*c*, the block-side water jacket 23*b*, and the regenerator 10 when the engine 1 is running.

Figure 8:
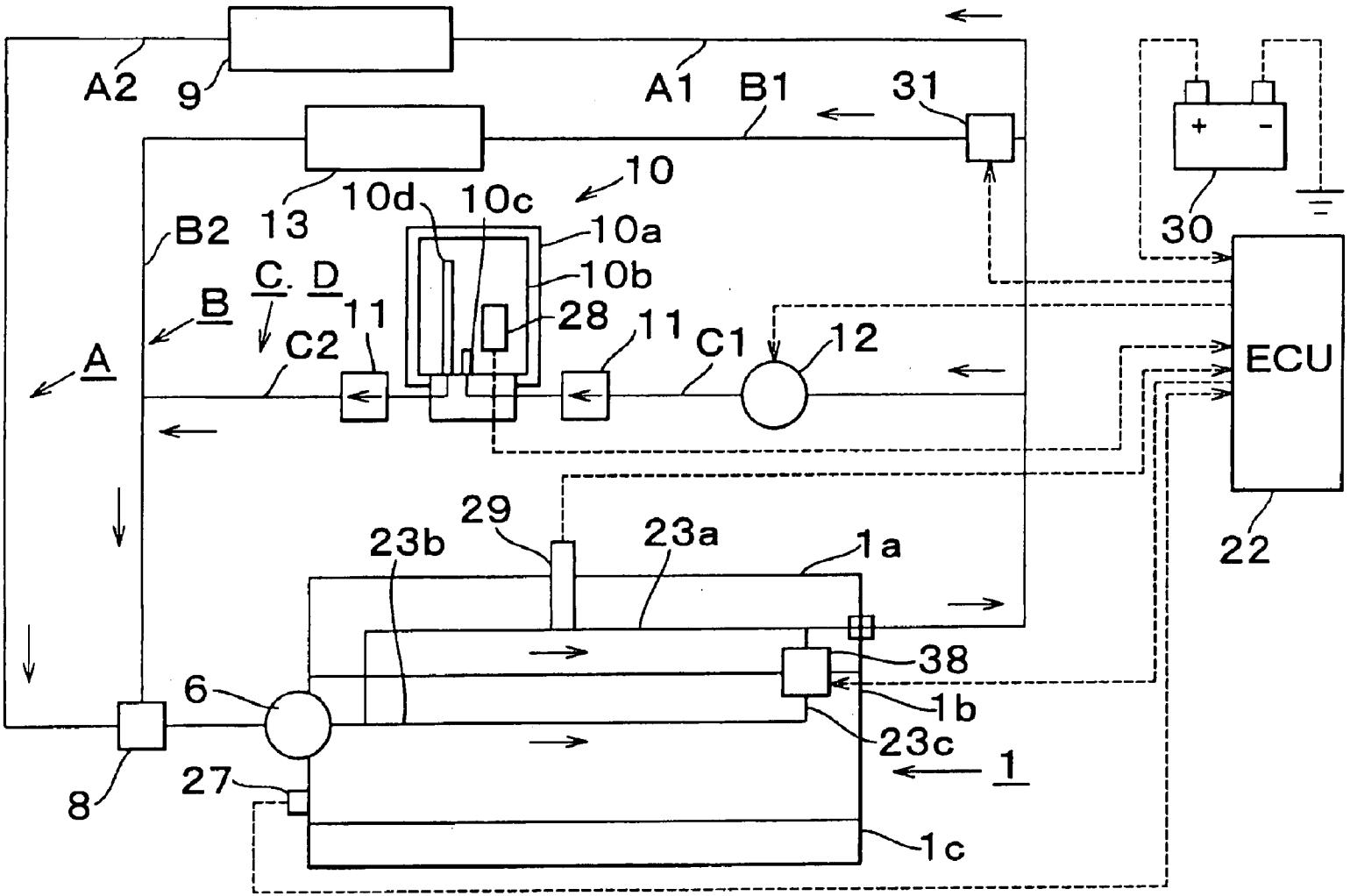
FIG. 8 is a schematic view of an engine applying to the regenerator of the internal combustion engine according to the fourth embodiment and cooling channels in which water coolant circulates.

FIG. 8 shows the circulation directions of water coolant. When the engine 1 is running, water coolant circulates in the directions of the arrows shown in FIG. 8.

Figure 9:
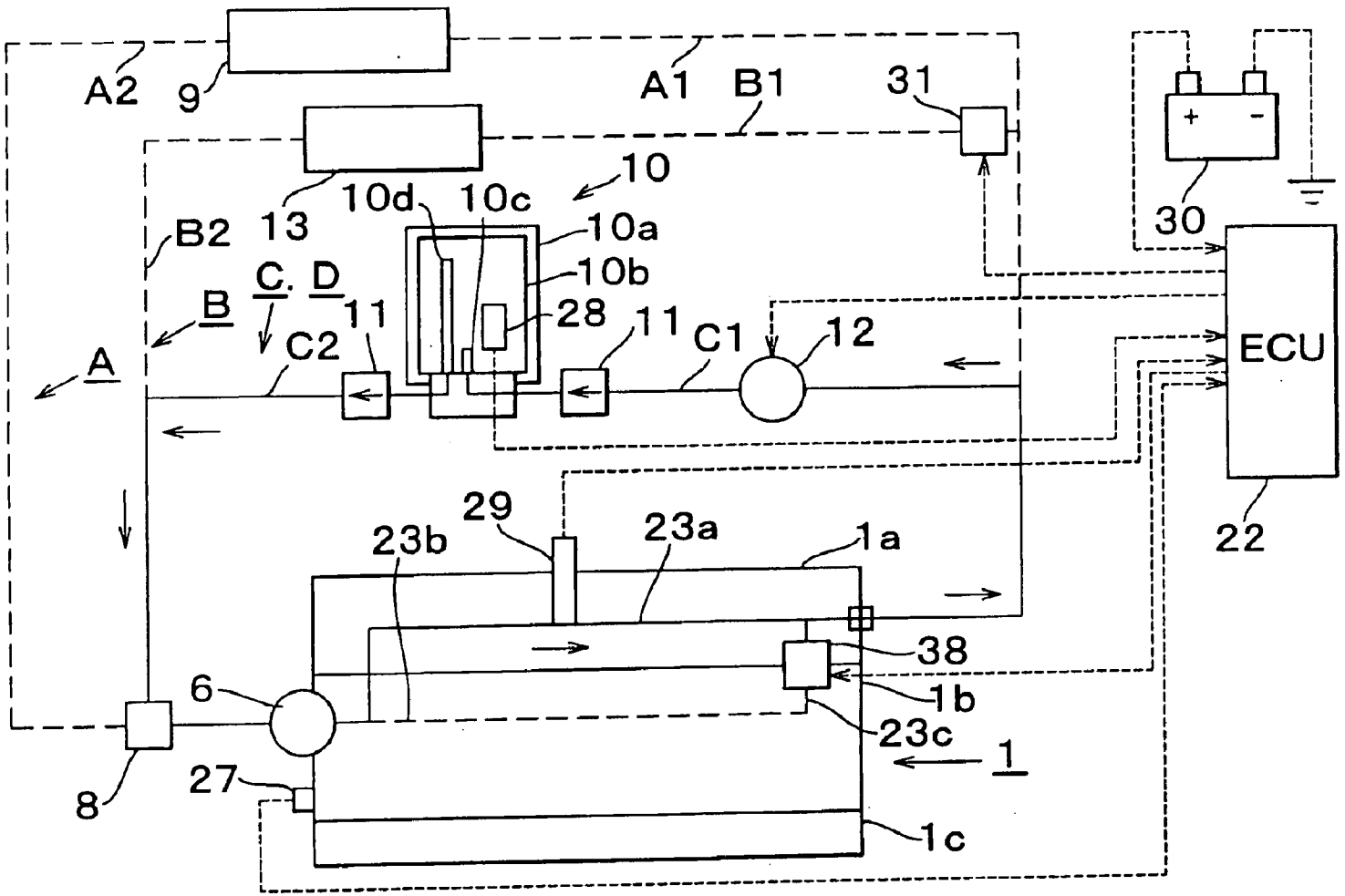
FIG. 9 is a view of the circulation directions of water coolant when engine-preheat is controlled according to the fourth embodiment.

On the other hand, FIG. 9 shows the circulation directions of water coolant when the engine 1 is turned off and heat needs to be supplied by circulating water coolant. And water coolant circulates in the directions of the arrows shown in FIG. 9. At this time, water coolant does not circulate in the heater core 13 since the shut-off valve 31 is closed. And water coolant does not circulate into the radiator 9 since the thermostat 8 is closed. Furthermore, water coolant does not circulate in the block-side water jacket 23*b* since the shut-off valve 38 is closed.

The basic composition relating to other hardware is substantially identical to the basic composition relating to other hardware according to the first embodiment. Therefore, the explanation of the basic composition relating to other hardware is omitted.

According to the present embodiment, the shut-off valves 31 and 38 are closed at a step corresponding to the step S102 in the flow chart shown in FIG. 4 according to the first embodiment. And it is not necessary to perform the control at the step S113.

As described above, simplifying controls and devices is possible since the number of the shut-off valves which need to be controlled is less than the number of the ones in the engine 1 with the regenerator 10 according to the first embodiment.

As described above, intensive raising temperature of the cylinder head 1*a* is possible by opening and closing the shut-off valves 31 and 38 when the engine 1 is turned off according to the present embodiment. Therefore, keeping raising temperature of the cylinder head 1*a* for a long period is possible by raising temperature of a part such as the cylinder block 1*b* where raising temperature is less needed and restraining heat consumption in the regenerator 10. And simplifying devices are possible since due to the commonization of the circulation channels C and D.

Furthermore, the amount of heat accumulated in the regenerator 10 can be decreased since the heat accumulated in the regenerator 10 can be utilized effectively. Therefore, downsizing the regenerator 10 and shortening time to supply heat is possible.

According to the present embodiment, the shut-off valve 31 can be replaced by a thermostat valve. The open valve temperature of the thermostat should be set lower than the open valve temperature of the thermostat 8.

The Fifth Embodiment

Figure 10:
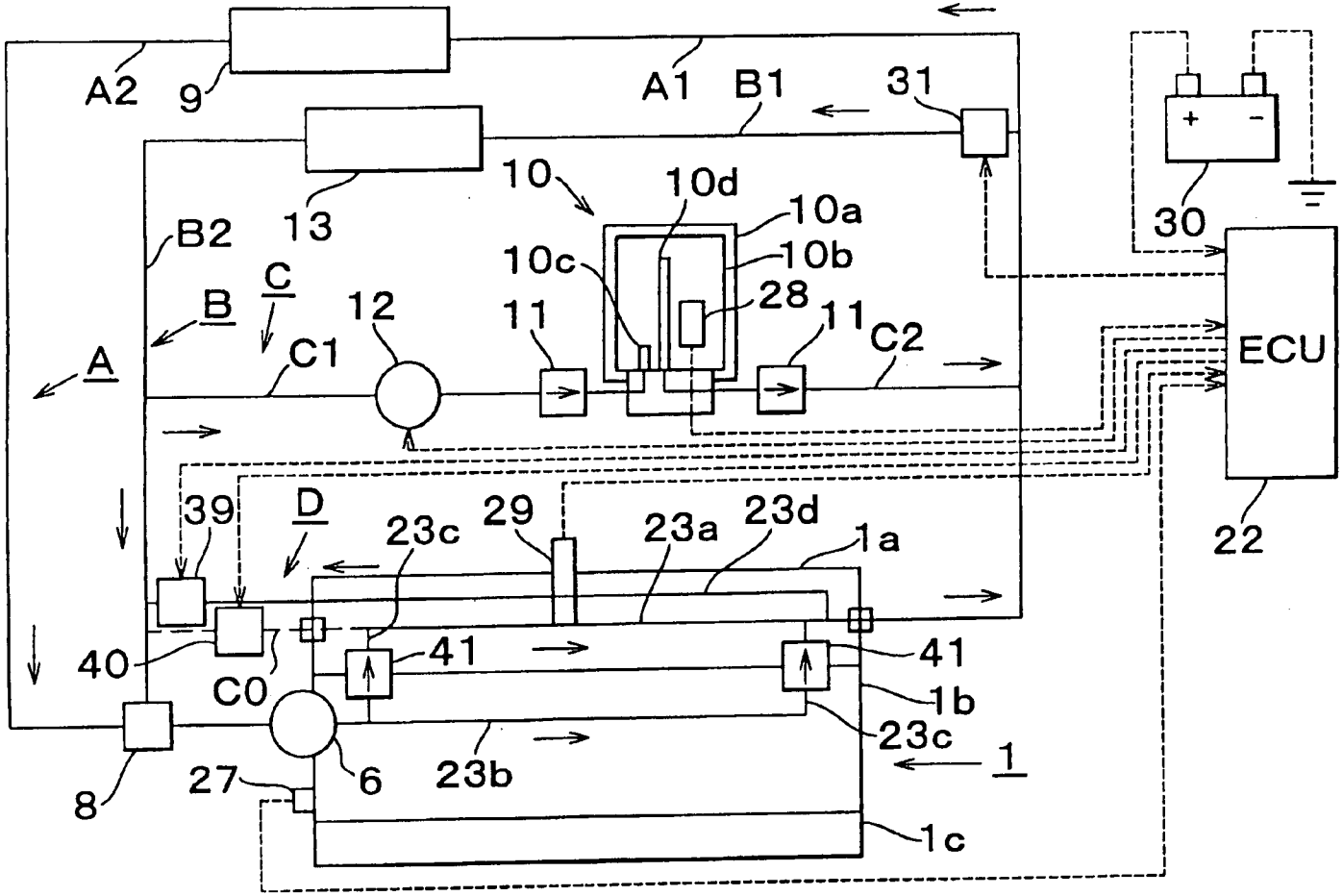
FIG. 10 is a schematic view of an engine applying to the regenerator of the internal combustion engine according to the fifth embodiment and cooling channels in which water coolant circulates.

FIG. 10 shows a schematic view of an engine 1 with the regenerator 10 according to the present embodiment and water coolant circulation channels A, B, C, and D through which water coolant as the heat medium flows. The arrows on the circulation channels show the circulation directions of water coolant when the engine 1 is running.

The following is the differences between an engine 1 equipped with the regenerator 10 according to the present embodiment and the engine 1 according to the first embodiment.

The engine 1 equipped with the regenerator 10 according to the present embodiment includes the connecting channel C0 which connects the cylinder head 1*a* with regenerator inlet-side channel C1. A shut-off valve 40, which opens and closed according to the signals from the ECU 22, is located midway of the connecting channel C0. The shut-off valve 40 is closed when heat is supplied to the engine 1 and opened when the engine 1 is running. And each connecting channel 23*c*, which connects head-side water jacket 23*a* with block-side water jacket 23*b* in the engine 1, includes the check valve 41. The check valve 41 allows water coolant to circulate from cylinder block 1*b* to cylinder head 1*a*.

The basic composition relating to other hardware is substantially identical to the basic composition relating to other hardware according to the first embodiment. Therefore, the explanation of the basic composition relating to-other hardware is omitted.

In the circulation channels formed according to the above description, the shut-off valve 40 is closed when the engine 1 is running. And the water coolant circulation is carried out like the water coolant circulation according to the first embodiment.

Figure 11:
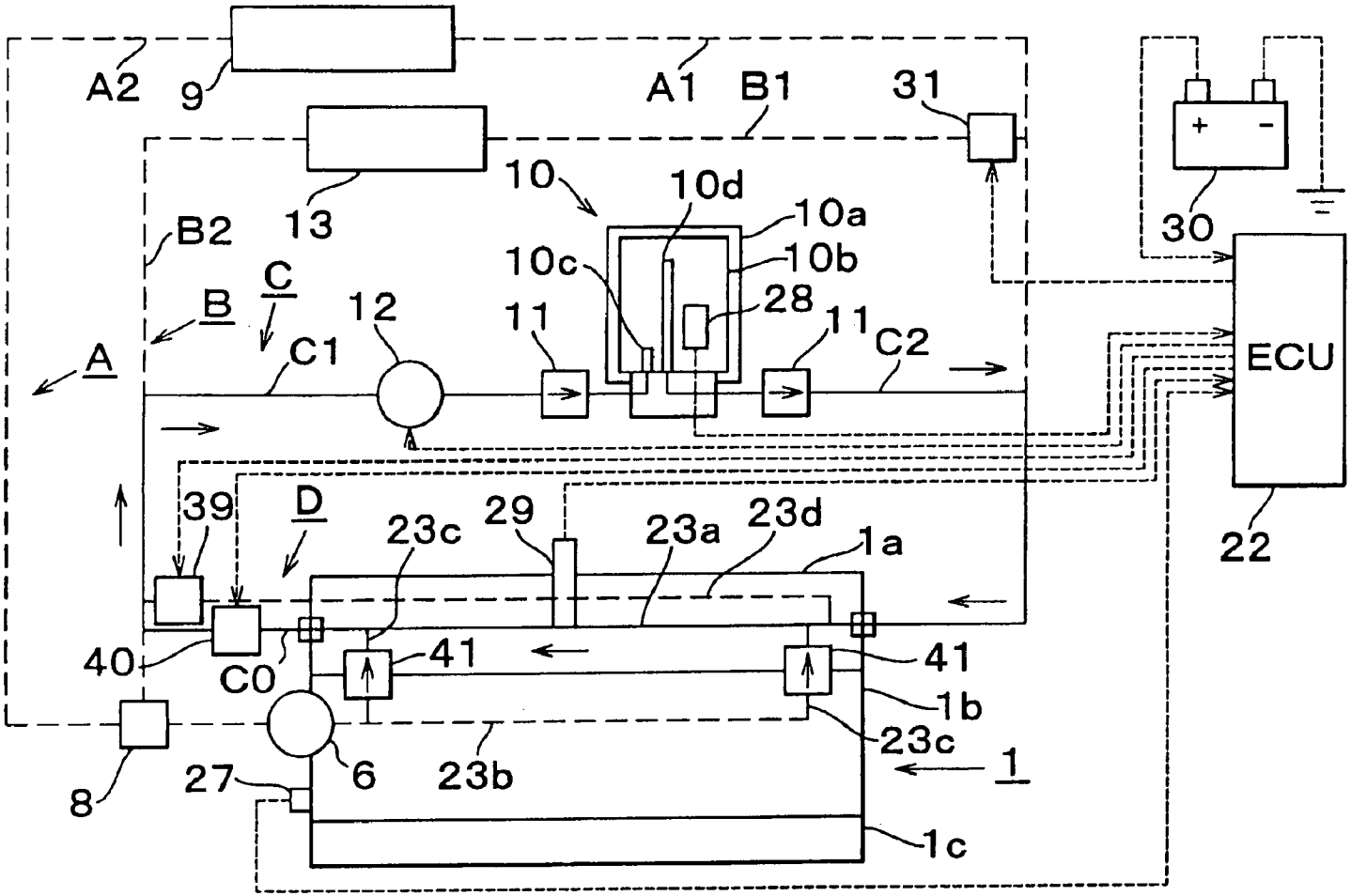
FIG. 11 is a view of the circulation directions of water coolant when engine-preheat is controlled according to the fifth embodiment.

FIG. 11 shows the circulation channels and the circulation directions of water coolant when the engine 1 is turned off and heat needs to be supplied to the engine 1 from the regenerator 10. The water coolant in the head-side water jacket 23*a*, when the engine 1 is running, flows in the opposite direction of the water coolant in the head-side water jacket 23*a* when heat is supplied from the regenerator 10 to the engine 1.

The shut-off valves 31 and 38 are closed and the shut-off valve 40 is opened by the ECU 22 when the engine-preheating control is performed. The electric water pump 12 is driven according to the signals from the ECU 22 and spurts out water coolant with a predetermined pressure. The spurted out water coolant reaches the regenerator 10 after flowing through the regenerator inlet-side channel C1 and passing the check valve 11. At this time, the water coolant, which flows into the regenerator 10, is the water coolant whose temperature is lowered when the engine 1 is turned off.

The water coolant, which is stored in the regenerator 10, flows out of the regenerator 10 through the water coolant extraction tube 10*d*. At this time, the water coolant, which flows out of the regenerator 10, is the water coolant which is insulated by the regenerator 10 after flowing into the regenerator 10 when the engine 1 is running. The water coolant, which flows out of the regenerator 10, flows into the cylinder head 1*a* after passing the check valve 11 and flowing through the regenerator outlet-side channel C2. When the engine 1 is turned off, water coolant does not circulate in the heater core 13 since the shut-off valve 31 is closed according to the signal from the ECU 22. And when water coolant temperature is higher than the opening valve temperature of the thermostat 8, it is not necessary to supply heat from the regenerator 10 to the engine 1. In other words, when water coolant circulates and the engine 1 is turned off, the thermostat 8 is always closed. Therefore, the water coolant temperature does not drop due to heat conduction since water coolant does not circulate in the heater core 13 and the radiator 9.

The water coolant, which flows into the cylinder head 1*a*, flows through the head-side water jacket 23*a*. The cylinder head 1*a* exchanges heat with the water coolant in the head-side water jacket 23. Some of the heat from the water coolant is conducted to the interior of the cylinder head 1*a* and the temperature of the entire cylinder head 1*a* rises. As a result, the temperature of the water coolant drops due to heat loss. At this time, water coolant does not circulate in the block-side water jacket 23*b* since the check valve 41 does not allow water coolant to flow from the head-side water jacket 23*a* to the block-side water jacket 23*b*. Therefore, the water coolant temperature does not drop in the cylinder block 1*b* due to heat conduction.

Furthermore, water coolant does not circulate in the bypass channel 23*d* since the shut-off valve 39 is closed by the signal from the ECU 22 when the engine is turned off. Therefore, water coolant always conducts heat in the head-side water jacket 23*a* before returning to the regenerator 10.

As described above, the water coolant, whose temperature is lowered by heat conduction in the head-side water jacket 23*a*, flows into the connecting channel after flowing out of the cylinder head 1*a*. Then the water coolant passes the shut-off valve 40 and flows into the regenerator inlet-side C1 since the shut-off valve 40 located midway of the connecting channel C0 is closed. The water coolant, which flows through the regenerator C1, reaches the electric pump 12. As described above, temperature of the cylinder head 1a can be raised by activating the electric water pump 12 when the engine 1 is turned off.

According to the present embodiment, the shut-off valves 31 and 39 are closed and the shut-off valve 40 is opened at a step corresponding to the step S102 in the flow chart shown in FIG. 4 according to the first embodiment. And the shut-off valve 39 is opened and the shut-off valve 40 is closed at a step corresponding to the step S113. In this connection, it is not necessary to perform the controls at the steps S117 and S118.

As described above, intensive raising temperature of the cylinder head 1*a* is possible by opening and closing the shut-off valves 31, 39 and 40 when heat is supplied from the regenerator 10 according to the present embodiment. Therefore, keeping raising temperature of the cylinder head 1*a* for a long period is possible by raising temperature of the cylinder block 1*b* and restraining heat consumption in the regenerator 10.

And the amount of heat accumulated in the regenerator 10 can be decreased since the heat accumulated in the regenerator 10 can be utilized effectively. Therefore, downsizing the regenerator 10 and shortening time to supply heat is possible.

According to the present embodiment, the check valve 41 can be replaced by valves such as a electromagnetic valve, a pressure-sensing valve, and a thermostat valve.

And the shut-off valve 39 is replaced by a pressure-sensing valve or a thermostat valve according to the present embodiment.

Furthermore, the shut-off valve 31 can be replaced by a thermostat valve according to the present embodiment. The open valve temperature of the thermostat should be set lower than the open valve temperature of the thermostat 8.

In each internal combustion engine with the regenerator according to each embodiment described above, dropping temperature of each internal combustion engine for a long period can be restrained by intensively supplying heat to a part where heat supply is needed even when starting each internal combustion engine is delayed for some reason.

As described above, deterioration of exhaust gas emission can be restrained since each internal combustion engine can be started under a high temperature according to each embodiment.

What is claimed is:

1. A system including an internal combustion engine comprising:

a regenerator that accumulates heat from a heat medium and transfers heat to the heat medium;

a circulation system that circulates the heat medium;

a heat medium supply device, provided in line with the circulation system, that supplies the heat medium including heat accumulated by the regenerator to the circulation system;

a heat exchanger that lowers the temperature of the heat medium; and a connecting restraint device that restrains circulation of the heat medium into the heat exchanger (a) when the heat medium is supplied by the heat supply device while the internal combustion engine is stopped and/or (b) when the internal combustion engine is under a cold condition, wherein the connecting restraint device includes a pressure-sensing valve, provided in line with the circulation system, which operates according to a difference in pressure between the pressures of the heat medium flowing before and after the connecting restraint device and thereby performs the restraint of the circulation of the heat medium into the heat exchanger.

2. A system including an internal combustion engine comprising:

a regenerator that accumulates heat from a heat medium and transfers heat to the heat medium;

a circulation system that circulates the heat medium;

a heat medium supply device, provided in line with the circulation system, that supplies the heat medium including heat accumulated by the regenerator to the circulation system;

a heat exchanger that lowers the temperature of the heat medium; and a connecting restraint device that restrains circulation of the heat medium into the heat exchanger (a) when the heat medium is supplied by the heat supply device while the internal combustion engine is stopped and/or (b) when the internal combustion engine is under a cold condition, wherein the connecting restraint device includes a one-way valve, provided in line with the circulation system, which opens when the valve receives pressure in a predetermined direction.

3. A system including an internal combustion engine comprising:

a regenerator that accumulates heat from a heat medium and transfers heat to the heat medium;

a circulation system that circulates the heat medium;

a heat medium supply device, provided in line with the circulation system, that supplies the heat medium including heat accumulated by the regenerator to the circulation system;

a bypass channel that connects an inlet side of the internal combustion engine with an outlet side of the internal combustion engine;

a temperature controller that reintroduces the heat medium circulated into the internal combustion engine when the internal combustion engine is under a cold condition through the bypass channel; and a connecting restraint device that is capable of restraining circulation of the heat medium into the bypass channel when the heat medium, including heat accumulated by the regenerator, is supplied to the internal combustion engine.

4. A system including an internal combustion engine according to claim 3, wherein the connecting restraint device is a thermostat valve which closes at temperatures no greater than a predetermined temperature and thereby performs the restraint of the circulation of the heat medium into the heat exchanger.

5. A system including an internal combustion engine according to claim 3, wherein the connecting restraint device includes a pressure-sensing valve, provided in line with the circulation system, which operates according to a difference in pressure between the pressures of the heat medium before and after the connecting restraint device and thereby performs the restraint of the circulation of the heat medium into the heat exchanger.

6. A system for an internal combustion engine according to claim 3, wherein the connecting restraint device includes an electromagnetic opening and closing valve.

7. A system for an internal combustion engine according to claim 3, further comprising a heat exchanger.

8. A system for an internal combustion engine according to claim 3, wherein the connecting restraint device is capable of restraining circulation of the heat medium into the bypass channel when the internal combustion engine is stopped.

9. A system for an internal combustion engine according to claim 3, further comprising an additional connecting restraint device, wherein the connecting restraint device and the additional connecting restraint device restrain circulation of the heat medium into said regenerator, a heat exchanger, and a radiator when the internal combustion engine is operated under a cold condition.

* * * * *